US010108135B2

(12) United States Patent
Yamada

(10) Patent No.: US 10,108,135 B2
(45) Date of Patent: Oct. 23, 2018

(54) IMAGE FORMING APPARATUS THAT CONTROLS A START PROCESS AND AN END PROCESS OF ROTATION OF A PHOTORECEPTOR

(71) Applicant: Konica Minolta, Inc., Tokyo (JP)

(72) Inventor: Tatsutoshi Yamada, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/450,122

(22) Filed: Mar. 6, 2017

(65) Prior Publication Data

US 2017/0285556 A1 Oct. 5, 2017

(30) Foreign Application Priority Data

Mar. 31, 2016 (JP) ..... 2016-072135

(51) Int. Cl.

| | |
|---|---|
| ***G03G 15/00*** | (2006.01) |
| ***G03G 21/10*** | (2006.01) |
| ***G03G 21/00*** | (2006.01) |
| ***G03G 21/14*** | (2006.01) |
| ***G03G 21/08*** | (2006.01) |

(52) U.S. Cl.

CPC ..... *G03G 21/10* (2013.01); *G03G 15/50* (2013.01); *G03G 15/5008* (2013.01); *G03G 21/0005* (2013.01); *G03G 21/0011* (2013.01); *G03G 21/08* (2013.01); *G03G 21/145* (2013.01)

(58) Field of Classification Search

CPC .... G03G 21/10; G03G 21/0011; G03G 21/14; G03G 21/145; G03G 15/50; G03G 15/5008

See application file for complete search history.

(56) References Cited

U.S. PATENT DOCUMENTS

2008/0271556 A1* 11/2008 Imamura ..... F16H 57/02004 74/412 R

FOREIGN PATENT DOCUMENTS

| | | |
|---|---|---|
| JP | 2011070117 A | 4/2011 |
| JP | 2014021261 A | 2/2014 |

* cited by examiner

*Primary Examiner* — David M Gray
*Assistant Examiner* — Laura Roth
(74) *Attorney, Agent, or Firm* — Lucas & Mercanti, LLP

(57) ABSTRACT

An electrophotographic image forming apparatus which sequentially performs charging, exposure, development, transfer and cleaning on each surface portion of a photoreceptor during rotation includes a cleaning blade configured to scrape off toner from the surface of the photoreceptor, a detecting unit configured to detect a rotation angle of the photoreceptor, and a control unit configured to control each of a start process and an end process of rotation of the photoreceptor. The control unit is also configured to control charging, development and transfer of the photoreceptor. In the end process, the control unit estimates a position of a surface portion of the photoreceptor, at which a charged state caused by a peeling discharge remains even after the stop of the photoreceptor, from the rotation angle from the time of start of deceleration of the photoreceptor to the time of stop of the photoreceptor, and adjusts parameters necessary for the next start process or end process.

10 Claims, 11 Drawing Sheets

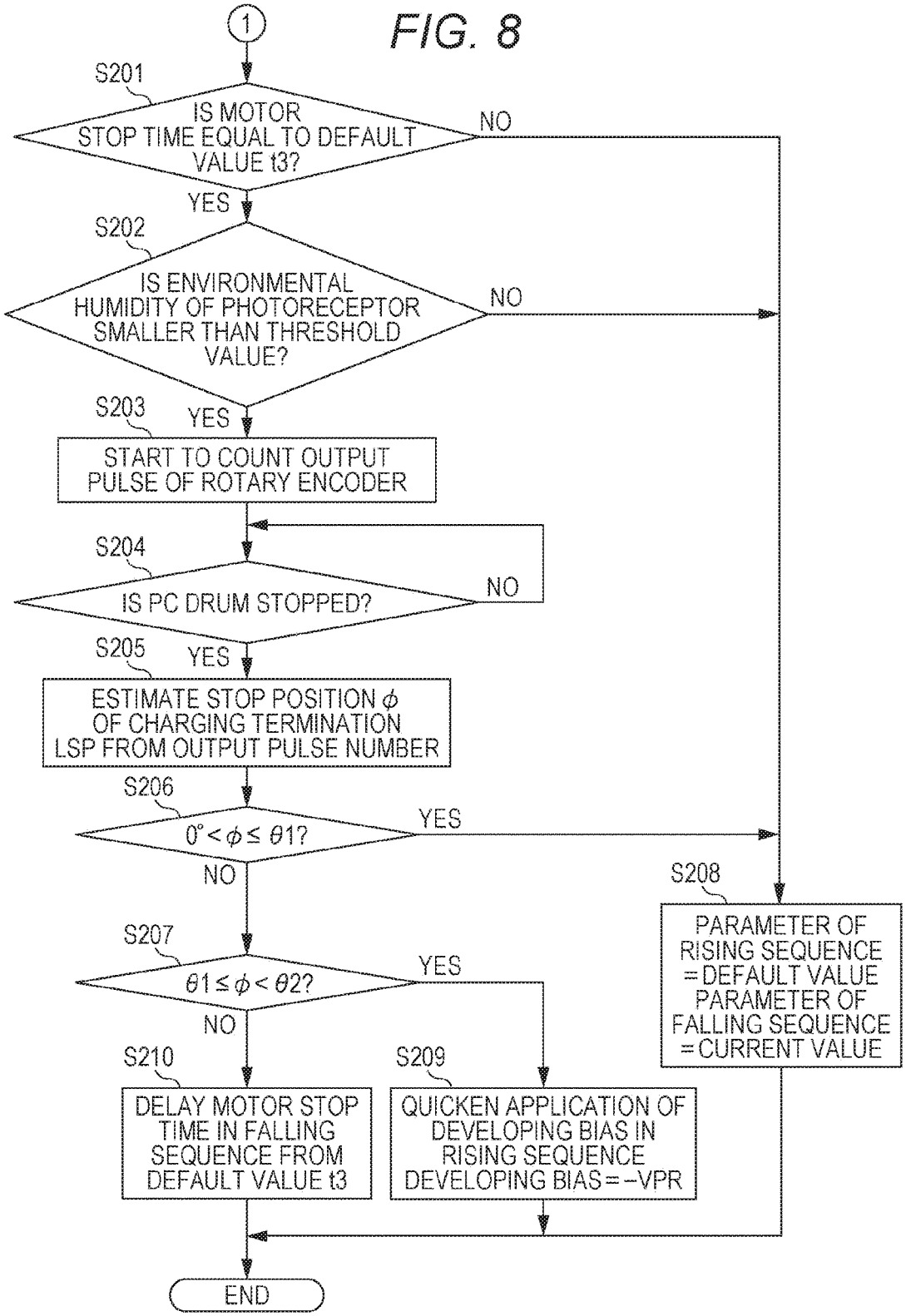
FIG. 8
1
S201
IS MOTOR STOP TIME EQUAL TO DEFAULT VALUE t3?
NO
YES
S202
IS ENVIRONMENTAL HUMIDITY OF PHOTORECEPTOR SMALLER THAN THRESHOLD VALUE?
NO
YES
S203
START TO COUNT OUTPUT PULSE OF ROTARY ENCODER
S204
IS PC DRUM STOPPED?
NO
YES
S205
ESTIMATE STOP POSITION φ OF CHARGING TERMINATION LSP FROM OUTPUT PULSE NUMBER
S206
0° < φ ≤ θ1?
YES
NO
S207
θ1 ≤ φ < θ2?
YES
NO
S208
PARAMETER OF RISING SEQUENCE = DEFAULT VALUE PARAMETER OF FALLING SEQUENCE = CURRENT VALUE
S210
DELAY MOTOR STOP TIME IN FALLING SEQUENCE FROM DEFAULT VALUE t3
S209
QUICKEN APPLICATION OF DEVELOPING BIAS IN RISING SEQUENCE DEVELOPING BIAS = −VPR
END

IMAGE FORMING APPARATUS THAT CONTROLS A START PROCESS AND AN END PROCESS OF ROTATION OF A PHOTORECEPTOR

The entire disclosure of Japanese Patent Application No. 2016-072135 filed on Mar. 31, 2016 including description, claims, drawings, and abstract are incorporated herein by reference in its entirety.

BACKGROUND OF THE INVENTION

Field of the Invention

The present invention relates to an electrophotographic image forming apparatus, and more particularly, to a process control thereof.

Description of the Related Art

Image formation using an electrophotographic method includes six processes of charging, exposure, development, transferring, fixing and cleaning. Among them, five processes except the fixing process use a photoreceptor as a direct object to be processed. Thus, in the electrophotographic image forming apparatus, the photoreceptor constitutes a rotating element such as a drum, and a belt, and five kinds of functional units are disposed around the photoreceptor. When the photoreceptor makes one rotation, each portion of the outer circumferential surface sequentially faces these functional units. For these portions, each functional unit specializes in charging, exposure, developing, transferring and cleaning. Thus, while the photoreceptor continues to rotate, each portion of the outer circumferential surface periodically continues to undergo five processes. In order to stably maintain a high image quality in the image forming apparatus, it is important to appropriately control the linkage between the rotation of the photoreceptor and the five processes, depending on switching of operation modes, fluctuation of environmental conditions, and deterioration with time of components.

For example, in an image forming apparatus disclosed in JP 2011-070117 A, an external additive having a lower resistance than the toner is retained in a contact portion between a photoreceptor and a cleaning blade. This external additive escapes charges from the toner scraped off by the blade, suppresses a peeling discharge, and prevents the damage to the photoreceptor caused thereby. However, the peeling discharge is hard to occur in a high humidity environment, whereas the retained external additive is likely to agglomerate into an excessive lump. This lump has a risk of hindering adhesion of toner to the surface of the photoreceptor and disturbing (filming) a horizontal stripe in the toner image. Therefore, when the risk of peeling discharge is low due to a high humidity, the device rotates the photoreceptor in reverse at the time of completion of the job process and levels the external additive to prevent its aggregation.

A copying machine disclosed in JP 2014-021261 A continues to rotate the photoreceptors for other colors even in a monochrome mode to keep job process at high speed and maintain high productivity. In this case, the copying machine periodically discharges toner to the photoreceptors to suppress the frictional force with the cleaning blade. This prevents troubles such as jitter, squealing and curling caused by excessive chatter (stick-slip) of the blade. The copying machine further applies a charging bias to the surface portion of the photoreceptor including the discharged toner after passage of the blade. This charging bias eliminates the charged state, even if the peeling discharge generated between the surface portion and the blade charges its surface portion. As a result, since the carrier contained in the two-component developer does not adhere to the surface portion thereof, the risk of filming or damage to the photoreceptor caused by the carrier is suppressed.

In the process control, the order of startup/stop of each element of the image forming apparatus accompanied by the start/end of the job process is restricted under various conditions. This order itself or the startup/stop control of this order is called a "rising/falling sequence". Specifically, for example, in the falling sequence, the stopping order of driving, charging, developing and transferring of the photoreceptor is defined as follows. 1. The polarity of the transfer bias is reversed at the time when the termination of the portion containing the toner image among the surface of the photoreceptor passes through the transfer unit. 2. The application of the charging bias is stopped at the time when the termination passes the charging unit. By keeping the charging bias up to this time, the portion before the termination is uniformly charged. 3. The application of the developing bias is stopped at the time when the termination has reliably passed through the developing unit. By keeping the developing bias up to this time, the carrier contained in the two-component developer is prevented from adhering before the termination. However, at this time point, since the uncharged portion just after the termination thereof receives the developing bias, toner (hereinafter, referred to as "fogging toner") adheres to this portion. 4. The application of the transfer bias, a drive motor of the photoreceptor, and an eraser are stopped at the later of the time when the termination passes through the eraser or the time when the termination passes through the cleaning blade. By keeping the transfer bias at the opposite polarity up to this time, movement of the fogging toner to the transfer unit is prevented, and by continuing to operate the eraser, the portion before the termination is discharged. Furthermore, by continuing to rotate the photoreceptor until this time, the blade is caused to scrape off the fogging toner by this time or after this time while the photoreceptor rotates with inertia.

In recent years, the particle diameter of the toner is reduced in order to further improve the image quality, and the rotational speed of the photoreceptor increases in order to further improve the productivity. Accordingly, in the falling sequence, there is a high risk of occurrence of peeling discharge between the cleaning blade and the photoreceptor at the time of removing the fogging toner. This is due to the following reason. A. With an increase in the speed of the rotation of the photoreceptor, the uncharged portion of the surface of the photoreceptor that receives the developing bias expands and the amount of fogging toner increases. B. With a decrease in the particle diameter of the toner, the surface shape of the lump of the toner scraped off by the blade is miniaturized and electric field concentration is easily generated. C. With an increase in the frictional force received by the photoreceptor from the blade, the amount of charge induced on the surface of the fogging toner peeled off from the surface of the photoreceptor increases.

Meanwhile, in the falling sequence, the eraser and the drive motor of the photoreceptor are stopped, on the later of the time when the termination of the portion of the photoreceptor surface which receives the charging bias passes through the eraser and the time when the termination passes through the cleaning blade. Therefore, generally, the uncharged portion immediately after the termination thereof cannot be subjected to the discharging process by the eraser after passing through the blade. Therefore, when the uncharged portion is charged by the peeling discharge, the carrier adheres to the uncharged portion, while the photoreceptor continues to rotate by inertia, or when the drive motor of the photoreceptor is started up next. These carriers have a high risk of causing image quality deterioration due to filming or a damage to the photoreceptor. However, it is difficult suppress this risk with the above-described falling sequence.

SUMMARY OF THE INVENTION

An object of the present invention is to solve the aforementioned problems, and in particular, to provide an image forming apparatus capable of achieving prolonged maintenance of high image quality and a long lifetime of a photoreceptor, by suppressing adhesion of a carrier to the photoreceptor caused by a peeling discharge at the time of stopping the rotation of the photoreceptor.

To achieve the abovementioned object, according to an aspect, there is provided an electrophotographic image forming apparatus which sequentially performs charging, exposure, development, transfer and cleaning on each surface portion of a photoreceptor during rotation, and the apparatus reflecting one aspect of the present invention comprises: a cleaning blade configured to scrape off toner from the surface of the photoreceptor; a detecting unit configured to detect a rotation angle of the photoreceptor; and a control unit configured to control each of a start process and an end process of rotation of the photoreceptor and charging, development and transfer of the photoreceptor, wherein, in the end process, the control unit estimates a position of a surface portion of the photoreceptor, at which a charged state caused by a peeling discharge when the cleaning blade scrapes off the toner remains even after the stop of the photoreceptor, from the rotation angle from the time of start of deceleration of the photoreceptor to the time of stop of the photoreceptor, and adjusts parameters necessary for the next start process or end process depending on the position.

The electrophotographic image forming apparatus preferably further comprises: a driving unit configured to rotate the photoreceptor; a charging unit configured to charge a surface of the photoreceptor; an exposure unit configured to irradiate the charged surface of the photoreceptor with light to form an electrostatic latent image; a developing unit configured to develop the electrostatic latent image as a toner image with a two-component developer; a transfer unit configured to transfer the toner image from the photoreceptor to a sheet; and a discharging unit configured to remove electric charge from the surface of the photoreceptor after the toner image is transferred. The parameters necessary for the start process preferably comprise startup timing of each unit of the driving unit, the charging unit, the developing unit, the transfer unit and the discharging unit or a bias voltage value of the developing unit. The parameters necessary for the end process preferably comprise a stop timing of each unit.

The control unit preferably first stops the charging unit in the end process, the control unit preferably stops the developing unit at a time point when the charging termination as the surface portion of the photoreceptor facing the charging unit at the time of the stop is assumed to face the developing unit, and the control unit preferably stops the discharging unit and the driving unit at a time point when the charging termination is assumed to face the discharging unit, and the control unit preferably estimates a stop position of the charging termination from a rotation angle from the time of stop of the driving unit to the time of stop of the photoreceptor, and the control unit preferably estimates the position of the surface portion of the photoreceptor at which the charged state caused by the peeling discharge remains, from the stop position.

When the stop position of the charging termination is between a position facing the charging unit and a position facing the developing unit, the control unit preferably sets the startup timing of the developing unit earlier than the startup timing of the charging unit, among the parameters necessary for the next start process, and sets a bias voltage value immediately after the startup of the developing unit to be closer to a ground voltage than a value at the time of development. The control unit preferably sets the startup timing of the developing unit earlier than the startup timing of the charging unit, at least by a time necessary for the driving unit to cause the rotational speed of the photoreceptor to reach a target value.

When the stop position of the charging termination is between a position facing the developing unit and a position facing the discharging unit, the control unit preferably delays the stop timing of the discharging unit and the driving unit, among the parameters necessary for the next end process. The control unit preferably delays the stop timing of the discharging unit and the driving unit, at least by a time necessary for the bias voltage value of the developing unit to return from the value at the time of development to the ground voltage.

The electrophotographic image forming apparatus preferably further comprises: a display unit configured to display characters, figures, or images. When the stop position of the charging termination is between a position facing the developing unit and a position facing the discharging unit, the control unit preferably displays a message, a symbol or an image warning that there is a risk of deterioration of the quality of the toner image, on the display unit.

The electrophotographic image forming apparatus preferably further comprises: a measuring unit configured to measure environmental conditions of the photoreceptor. The control unit preferably determines whether a probability of occurrence of the peeling discharge exceeds an allowable upper limit from the environmental conditions measured by the measuring unit, and when exceeding the allowable upper limit, the control unit preferably estimates the position of the surface portion of the photoreceptor at which the charged state caused by the peeling discharge remains.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4A illustrates a polarity inversion of a transfer bias;

FIG. 4B illustrates the stop of the application of the charging bias;

FIG. 4C illustrates the stop of the application of the developing bias and the adhesion of the fogging toner to the photoreceptor;

FIG. 4D illustrates the removal of the fogging toner from the photoconductor by the cleaning blade and the charging of the photoreceptor accompanied with the peeling discharge;

FIG. 4E illustrates a transition from ON to OFF of the eraser;

FIG. 4F illustrates a typical stop position of the charging termination;

FIG. 8 is the latter half of a flowchart of process control in the falling sequence illustrated in FIGS. 4A to 4F;

DESCRIPTION OF THE PREFERRED EMBODIMENTS

Hereinafter, an embodiment of the present invention will be described with reference to the drawings. However, the scope of the invention is not limited to the illustrated examples.

[External Shape of Image Forming Apparatus]

Figure 1A:
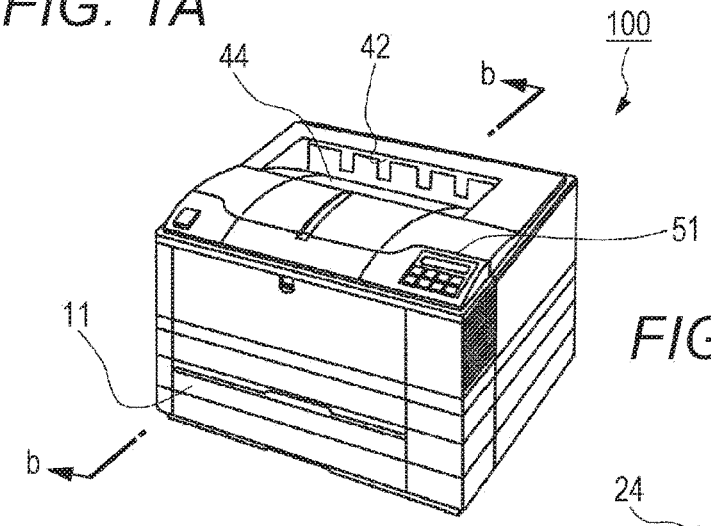
FIG. 1A is a perspective view illustrating an external shape of an image forming apparatus according to an embodiment of the present invention.

FIG. 1A is a perspective view illustrating an external shape of an image forming apparatus 100 according to an embodiment of the present invention. The image forming apparatus 100 is a laser printer. Referring to FIG. 1A, a sheet discharge tray 44 is provided on an upper surface of a casing of the printer 100, and a sheet discharged from a sheet discharge port 42 opened at the back thereof is stored. An operation panel 51 is embedded in front of the sheet discharge tray 44. A sheet feeding cassette 11 is drawably attached to the bottom of the printer 100.

[Internal Structure of Image Forming Apparatus]

Figure 1C:
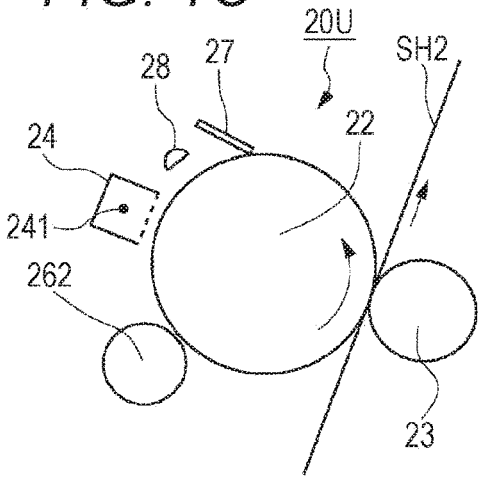
FIG. 1C is a schematic diagram of a photoreceptor unit indicated by B.
Figure 1B:
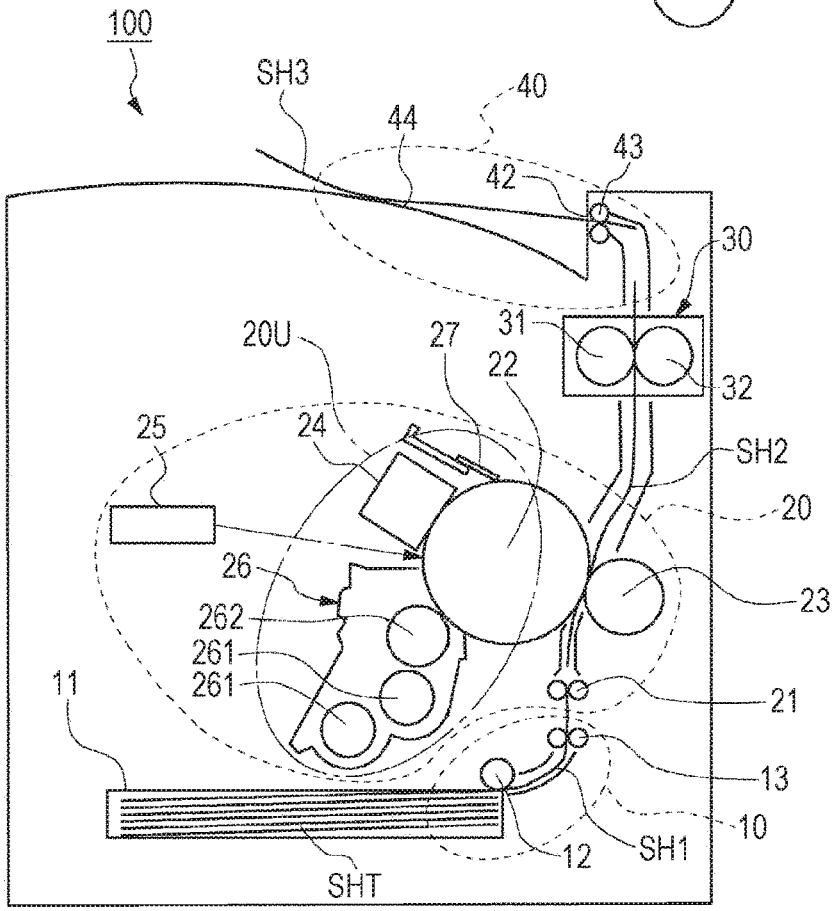
FIG. 1B is a schematic sectional view of the image forming apparatus taken along the line b-b illustrated in FIG. 1A.

FIG. 1B is an example of a schematic cross-sectional view of the printer 100 taken along a line b-b illustrated in FIG. 1A. Referring to FIG. 1B, the printer 100 includes a feeding unit 10, an image forming unit 20, a fixing unit 30, and a sheet discharge unit 40. These elements 10, 20, 30 and 40 cooperate with each other to function as an image forming unit, and form a toner image on the sheet based on the image data.

The feeding unit 10 uses a conveying roller 12 and a sheet feeding roller 13 to separate the sheets SH1 one by one from a bundle SHT of sheets stored in a sheet feeding cassette 11, and feeds the sheets SH1 to the image forming unit 20. The term "sheet" refers to a thin film-like or thin plate-like material, article or printed matter made of sheet or resin. The type of sheet that can be stored in the sheet feeding cassette 11, that is, the sheet type, is plain sheet, high-quality sheet, color sheet or coated sheet, and its size is A3 , A4 , A5 or B4. Furthermore, the posture of the sheet can be set both in a vertical position and in a horizontal position.

The image forming unit 20 forms a monochrome toner image on the sheet SH2 sent from the feeding unit 10. Specifically, first, the timing roller 21 temporarily stops the sheet arriving from the sheet feeding cassette 11, and allows the sheet to pass through a nip between the photoreceptor (PC) drum 22 and the transfer roller 23 in accordance with the timing indicated by the drive signal from a main control unit 60 (see FIGS. 5A and 5B). In parallel with the operation, the photoreceptor unit 20U forms a monochrome toner image such as black (K) on the surface of the PC drum 22. With the rotation of the PC drum 22, the toner image moves to the nip between the PC drum 22 and the transfer roller 23 and is transferred onto the surface of the sheet SH2 made to pass through the nip at the same time. Thereafter, the PC drum 22 and the transfer roller 23 send the sheet SH2 to the fixing unit 30.

The fixing unit 30 thermally fixes the toner image to the sheet SH2 sent from the image forming unit 20. Specifically, the fixing unit 30 causes the sheet SH2 to pass through the nip between the fixing roller 31 and the pressure roller 32, while rotating the fixing roller 31 and the pressure roller 32. At this time, the fixing roller 31 applies the heat of a built-in heater to the surface of the sheet SH2, and the pressure roller 32 applies the presses to the heated portion of the sheet SH2 to be pressed against the fixing roller 31. The toner image is fixed onto the surface of the sheet SH2 by the heat from the fixing roller 31 and the pressure from the pressure roller 32. The fixing unit 30 further sends the sheet SH2 to the sheet discharge unit 40 by the rotation of the fixing roller 31 and the pressure roller 32.

The sheet discharge unit 40 discharges the sheet SH3 with the toner image fixed thereon from the sheet discharge port 42 to the sheet discharge tray 44. Specifically, the sheet discharge unit 40 rotates the sheet discharge roller 43 disposed inside the sheet discharge port 42, and sends the sheet SH3 having moved from the upper portion of the fixing unit 30 to the sheet discharge port 42 to the outside of the sheet discharge port 42 and places the sheet SH3 on the sheet discharge tray 44.

[Structure of Photoreceptor Unit]

FIG. 1C is a schematic diagram of the photoreceptor unit 20U illustrated in FIG. 1B. Referring to FIGS. 1B and 1C, the photoreceptor unit 20U includes a charging unit 24, a developing unit 26, a cleaning blade 27, and an eraser 28, which are disposed around the PC drum 22.

The PC drum 22 is a cylindrical member made of a conductor such as aluminum with an outer circumferential surface covered with a photoreceptor, and is rotatably supported around a central axis (in FIG. 1B, an axis passing through the center of the circular cross section of the PC drum 22 perpendicularly to the sheet plane). The photoreceptor is a material in which the charge amount changes depending on the exposure amount, and includes, for example, a laminated structure (OPC) of an inorganic material such as amorphous selenium, selenium alloy and amorphous silicon, or a plurality of organic materials. Although it is not illustrated in FIG. 1B, the central axis of the PC drum 22 is connected to a drive motor through a transmission mechanism of rotational force, such as gears and belts. When the PC drum 22 makes one rotation (in FIG. 1B, in a counterclockwise direction CCW) by the rotational force from the drive motor, each surface portion of the photoreceptor sequentially faces the surrounding functional units 24, 25, 26, 23, 27 and 28.

The charging unit 24 includes a wire or thin plate-like electrode 241 which extends in the axial direction at an interval from the outer circumferential surface of the PC drum 22. By applying, for example, a negative high voltage (−several hundreds to −several thousands of V, hereinafter, referred to as "charging bias") to the electrode 241, the charging unit 24 generates the discharge between the electrode 241 and the outer circumferential surface of the PC drum 22. The discharge charges the surface portion of the photoreceptor facing the electrode 241 to negative polarity. The charged portion passes through the gap between the charging unit 24 and the developing unit 26 with the rotation of the PC drum 22. The exposure unit 25 irradiates the charged portion of the PC drum 22 with laser beam through the gap. The amount of laser beam is modulated by the exposure unit 25, based on the gradation value indicated by the image data. Meanwhile, in the charged portion of the PC drum 22, in the region irradiated with the laser beam, the charge amount decreases depending on the amount of received beam. Therefore, a distribution of the charge amount corresponding to the distribution of the gradation value indicated by the image data, that is, an electrostatic latent image is generated in the charged portion.

With the rotation of the PC drum 22, the surface portion of the PC drum 22 including the electrostatic latent image faces the developing unit 26. First, the developing unit 26 agitates the two-component developer DVL with two auger screws 261, and charges the toner contained in the developer DVL into negative polarity by the friction at that time. Next, the developing unit 26 rotates the developing roller 262 to cover its outer circumferential surface with the developer DVL, and brings the outer circumferential surface close to the opposing surface of the PC drum 22. In parallel with this, the developing unit 26 applies a negative high voltage (−several hundred to −several thousands of V, hereinafter, referred to as "developing bias") to the developing roller 262. As a result, since the potential of the electrostatic latent image is higher than that of the developing roller 262 in the region having the relatively small amount of charge, the toner separates from the developer covering the outer circumferential surface of the developing roller 262 and adheres. The electrostatic latent image is developed by this toner.

With the rotation of the PC drum 22, the actualized toner image moves to the nip between the PC drum 22 and the transfer roller 23. At this time, since a positive high voltage (about several hundreds to several thousands of V, hereinafter, referred to as "transfer bias") is applied to the transfer roller 23, the negatively charged toner image is transferred from the surface of the PC drum 22 to the surface of the sheet SH2 which simultaneously passes through the same nip.

The surface portion of the photoreceptor including the trace of the toner image transferred to the sheet SH2 comes into contact with the cleaning blade 27 with the rotation of the PC drum 22. The cleaning blade 27 is a thin rectangular plate-like member made of a thermosetting resin such as polyurethane rubber, and the length thereof is substantially equal to the portion of the outer circumferential surface of the PC drum 22 covered with the photoreceptor. One of the plate surfaces of the blade 27 that faces the outer circumferential surface of the PC drum 22 comes into contact with the outer circumferential surface of the PC drum 22 in a state in which one of its long sides (edge) is parallel to the axis of the PC drum 22, and the one plate surface obliquely intersects with the tangential plane of the outer circumferential surface at the edge. This contact follows the reading method. That is, the portion of the outer circumferential surface of the PC drum 22 which comes into contact with the edge of the blade 27 faces the plate surface of the blade 27 immediately after the contact, by the rotation of the PC drum 22. The blade 27 scrapes off the toner remaining on the transfer trace of the toner image from the surface portion of the photoreceptor coming into contact with the edge.

The surface portion faces the eraser 28 with the rotation of the PC drum 22. The eraser (also referred to as "pre-exposure unit") 28 includes, for example, light emitting diodes (LEDs) arranged in the axial direction of the PC drum 22, and faces the surface portion of the photoreceptor earlier than the charging unit 24 to irradiate the portion with light and discharge that portion. Thereafter, this surface portion faces the charging unit 24 again with the rotation of the PC drum 22.

[Transmission Mechanism of Rotational Force from Drive Motor to Photoreceptor Drum]

Figure 2A:
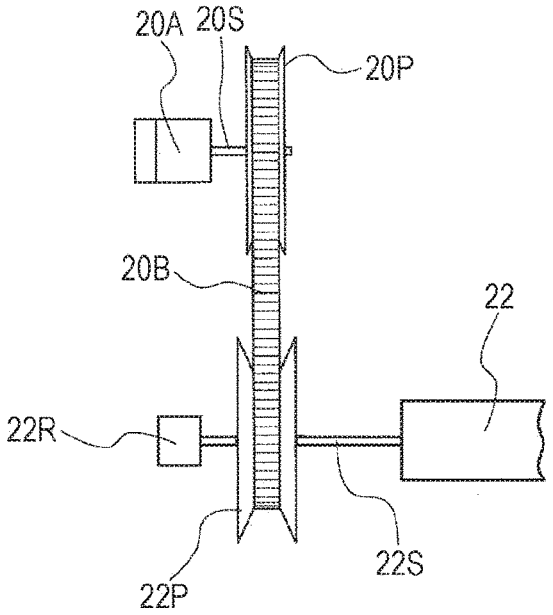
FIG. 2A is a partial side view of a mechanism for transmitting rotational force between the photoreceptor drum and the drive motor thereof illustrated in FIG. 1B.

FIG. 2A is a partial side view of a mechanism for transmitting a rotational force between the PC drum 22 and its drive motor (hereinafter, referred to as "PC motor") 20A. Referring to FIG. 2A, the transmission mechanism includes a driving pulley 20P, a driven pulley 22P, a belt 20B, and a rotary encoder 22R. The driving pulley 20P is coaxially fixed to a shaft 20S of the PC motor 20A. The driven pulley 22P is coaxially fixed to a central axis 22S of the PC drum 22. The belt 20B is wound around the driving pulley 20P and the driven pulley 22P. When the PC motor 20A rotates the shaft 20S, the driving pulley 20P rotates accordingly, and the driven pulley 22P is rotated through the belt 20B. In this way, since the torque of the PC motor 20A is transmitted to the central axis 22S of the PC drum 22, the PC drum 22 and the rotary encoder 22R rotate around the central axis 22S. Here, the outer diameter ratio between the two pulleys 20P and 22P is designed such that the tangential speed of the outer circumferential surface of the PC drum 22 coincides with the speed of the sheet passing through the nip between the PC drum 22 and the transfer roller 23.

Figure 2B:
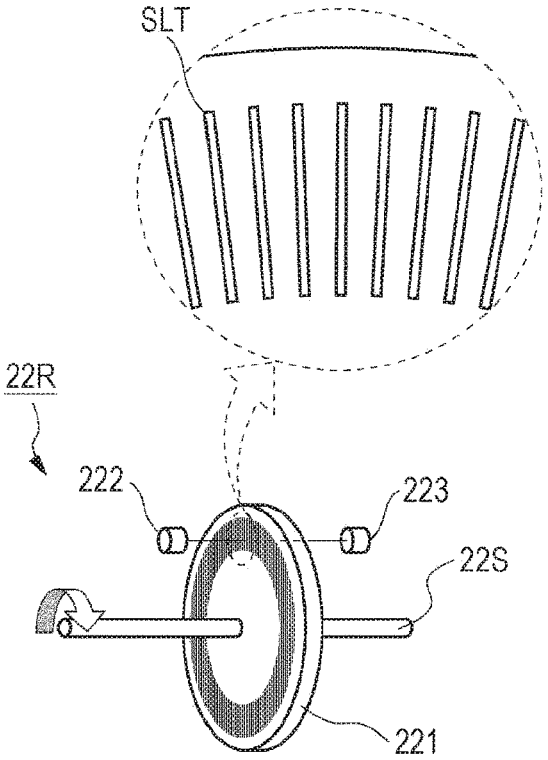
FIG. 2B is a schematic diagram of a rotary encoder illustrated in FIG. 2A.

FIG. 2B is a schematic diagram of the rotary encoder 22R. Referring to FIG. 2B, the rotary encoder 22R is an increment type, and includes a rotary plate 221, a light emitting element 222, and a light receiving element 223. The rotary plate 221 is a disk fixed coaxially to the central axis 22S of the PC drum 22, and includes a plurality of slits SLT. These slits SLT are radially opened at a position of a constant radius, and all the slits have the same size and the same shape and are arranged at equal intervals in the circumferential direction. The light emitting element 222 and the light receiving element 223 face each other with one point on the track of the slits SLT interposed therebetween, and are disposed such that light emitted from the light emitting element 222 is incident on the light receiving element 223 through the slits SLT. While the rotary plate 221 rotates with the rotation of the PC drum 22, each time one of the slits SLT passes through the optical path from the light emitting element 222 to the light receiving element 223, the light of the light emitting element 222 is detected by the light receiving element 223. In accordance with this detection, the rotary encoder 22R outputs pulses one by one. Therefore, it is possible to detect the rotation angle of the rotary plate 221, that is, the rotation angle of the PC drum 22 from the number of output pulses of the rotary encoder 22R.

[Electronic Control System of Image Forming Apparatus]

Figure 3:
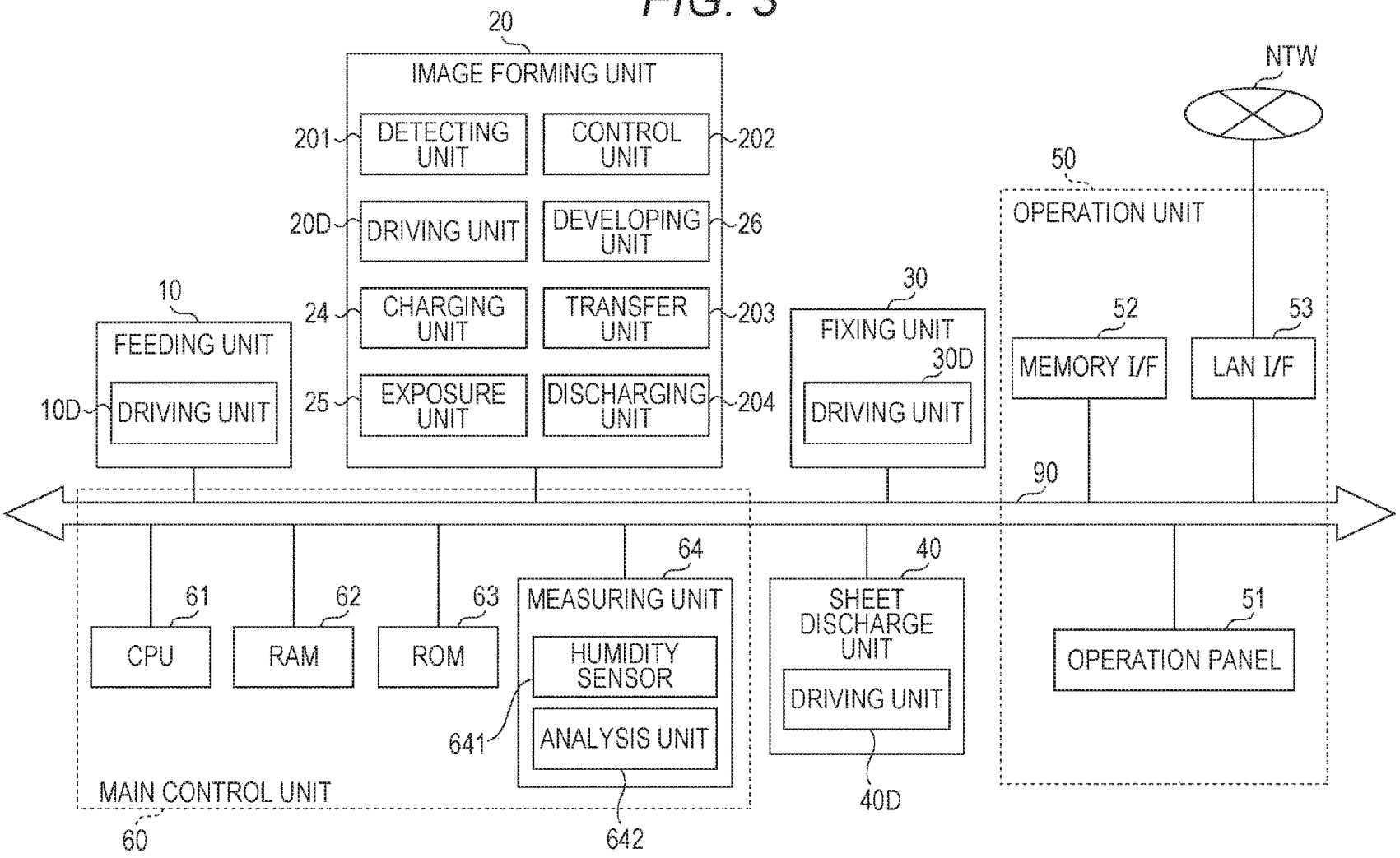
FIG. 3 is a block diagram illustrating a configuration of an electronic control system of the image forming apparatus illustrated in FIGS. 1A to 1C.

FIG. 3 is a block diagram illustrating a configuration of an electronic control system of the printer 100. Referring to FIG. 3, in this control system, in addition to the respective elements 10, 20, 30, and 40 of the printer 100, an operation unit 50 and a main control unit 60 are connected so as to communicate with each other through a bus 90.

—Driving Unit—

Each of the elements 10 to 40 of the printer 100 includes driving units 10D, 20D, 30D and 40D. Each of the driving units 10D to 40D controls a drive motor for the conveying rollers 12, 13, 21, 22, 23, 31, and 43. Although it is not illustrated in FIG. 3, specifically, each of the driving units 10D to 40D includes a control circuit and a driving circuit, in addition to these motors. The motors include a PC motor 20A, and, for example, are DC brushless (BLDC) motors. The control circuit is an electronic circuit such as a microprocessor (MPU/CPU), an application specific integrated circuit (ASIC) or a programmable integrated circuit (FPGA), and instructs a target value of the voltage applied to the motor to the driving circuit, based on the actual rotational speeds which are fed back from the motor. The driving circuit is an inverter, and applies a voltage to the motor, using a switching element such as a power transistor (FET). By utilizing the feedback control of the control circuit and the driving circuit, each of the driving units 10D to 40D maintains the conveying speed of the sheet by the conveying roller 12, in particular, at the target value instructed by the main control unit 60.

—Operation Unit—

The operation unit 50 accepts a job request and image data to be printed through the user's operation or communication with an external electronic device, and transmits the job request and the image data to the main control unit 60. Referring to FIG. 3, the operation unit 50 includes an operation panel 51, a memory interface (I/F) 52, and a network (LAN) I/F 53. The operation panel 51 includes a push button, a touch panel, and a display. On the display, the operation panel 51 displays a graphics user interface (GUI) screen such as an operation screen and an input screen of various parameters. The operation panel 51 also identifies a push button pressed by the user among the push buttons or detects the position touched by the user from the touch panel, and transmits information on the identification or detection to the main control unit 60 as operation information. In particular, when the input screen of the print job is displayed on the display, the operation panel 51 accepts from the user the printing conditions related to printing, such as the size of the sheet to be printed, the type of sheet, the posture (whether vertically or horizontally placed), the number of copies, color/monochrome and the image quality, and incorporates items indicating these conditions into the operation information. The memory I/F 52 includes a USB port or a memory card slot, and directly receives image data to be printed from an external storage device such as a USB memory or a hard disk drive (HDD) through the USB port or the memory card slot. The LAN I/F 53 is wired or wirelessly connected to the external network NTW, and receives image data to be printed from another electronic device connected to the network NTW.

—Main Control Unit—

The main control unit 60 is an integrated circuit mounted on one printed circuit board installed inside the printer 100. Referring to FIG. 3, the main control unit 60 includes a CPU 61, a RAM 62, a ROM 63, and a measuring unit 64. The CPU 61 is constituted by a single MPU, and attains various functions as a control entity for the other elements 10 and the like, by executing various types of firmware. For example, the CPU 61 causes the operation unit 50 to display the GUI screen to accept an input operation of the user. In accordance with this input operation, the CPU 61 determines an operation mode of the printer 100, such as an operation mode, a standby (low power) mode and a sleep mode, and instructs the process depending on the operation mode to the elements 10 to 40. In particular, the CPU 61 selects the target value of the sheet conveying speed depending on the sheet type or the sheet thickness of the sheet indicated by the operation information from the operation unit 50, and instructs the target value to the respective driving units 10D to 40D of the printer 100. The RAM 62 is a volatile semiconductor memory device such as a DRAM and a SRAM, which provides a work region for the CPU 61 when the CPU 61 executes the firmware, and preserves the image data of the print object accepted by the operation unit 50. The ROM 63 is made up of a combination of an unwritable nonvolatile memory device and a writable nonvolatile memory device. The former stores firmware, and the latter includes a semiconductor memory device such as an EEPROM, a flash memory and an SSD, or an HDD, and provides a preservation region for environment variables and the like to the CPU 61. The measuring unit 64 includes a humidity sensor 641 and an analyzing unit 642. The humidity sensor 641 includes a material such as a polymer or the like in which resistance or electrostatic capacity changes depending on the environmental humidity, and is disposed in the vicinity of the photoreceptor drum 22 or in a space communicating with the vicinity thereof. The analyzing unit 642 is an electronic circuit such as an MPU/CPU, an ASIC or an FPGA, and measures the environmental humidity of the photoreceptor from the output signal of the humidity sensor 641.

—Image Forming Unit—

Referring to FIG. 3, the control system of the image forming unit 20 includes a detecting unit 201, a control unit 202, a transfer unit 203 and a discharging unit 204, in addition to the driving unit 20D, the charging unit 24, the exposure unit 25, and the developing unit 26. The detecting unit 201 includes a rotary encoder 22R and a counter for its output pulse, and detects the rotation angle of the PC drum 22 from the number of the pulses. The control unit 202 is an electronic circuit such as an MPU/CPU, an ASIC and an FPGA, and controls the rotation of the PC drum 22 and the start process and the end process of five processes for the photoreceptor, that is, arising sequence and a falling sequence of the process control. The control unit 202 particularly stores the values of the parameters necessary for each sequence in its own memory or on a built-in memory of the same board. The transfer unit 203 includes a transfer roller 23 and a control circuit of the transfer bias. The discharging unit 204 includes an eraser 28 and a driving circuit thereof. Among the elements 20D, 24, 25, 26, 201, 202, 203 and 204 of the image forming unit 20, the portions which are constituted by electronic circuits, are mounted on a printed circuit board separate from the main control unit 60 and are installed inside the printer 100.

[Falling Sequence of Process Control]

FIGS. 4A to 4F are schematic diagrams illustrating a falling sequence of the photoreceptor unit 20U. With the completion of the job process by the image forming unit 20, the control unit 202 stops the elements of the photoreceptor unit 20U, that is, the driving unit 20D, the charging unit 24, the developing unit 26, the transfer unit 203, and the discharging unit 204 in accordance with the next falling sequences. 1. The polarity of the transfer bias is reversed at the time when the termination of the portion of the photoreceptor surface including the toner image passes the transfer roller 23. 2. The application of the charging bias is stopped when the termination passes the charging unit 24. 3. The application of the developing bias is stopped at the time when the termination reliably passes through the developing roller 262. 4. At the time when the termination passes through the eraser 28, the application of the transfer bias, the PC motor 20A, and the eraser 28 are stopped.

Figure 4A:
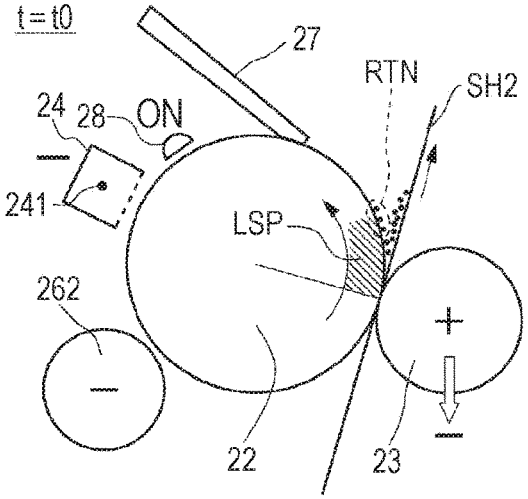
FIGS. 4A to 4F are schematic diagrams illustrating a falling sequence of the photoreceptor unit illustrated in FIG. 1C.

FIG. 4A illustrates the polarity inversion of the transfer bias. The control unit 202 measures the elapsed time t from the time when the exposure unit 25 finishes the irradiation of the laser beam modulated with the image data to be processed. When the surface portion (hatched portion in FIG. 4A) LSP of the photoreceptor which was lastly irradiated with this laser beam passes through the nip between the PC drum 22 and the developing roller 262, the surface portion becomes the termination in the circumferential direction (hereinafter, referred to as "toner image termination") among the surface portions of the photoreceptor on which the requested toner image of the job is formed. The control unit 202 assumes a time counting value t=t0 (hereinafter, referred to as "transfer completion time") indicating the passage time. As illustrated in FIG. 4A, at the time t0, the toner image termination LSP and the sheet SH2 pass through the nip between the PC drum 22 and the transfer roller 23. During the passage, since the transfer bias is kept at a positive value (hereinafter, referred to as "transfer voltage") of about several hundreds of to several thousands of V, the toner image is transferred from the termination LSP to the sheet SH2. When the time counting value t reaches the transfer completion time t0, the control unit 202 causes the transfer unit 203 to start the polarity inversion of the transfer bias. For example, the transfer bias starts to transition from a transfer voltage to a negative value (hereinafter, referred to as "cleaning voltage") of about −several hundreds to −several thousands of V.

Figure 4B:
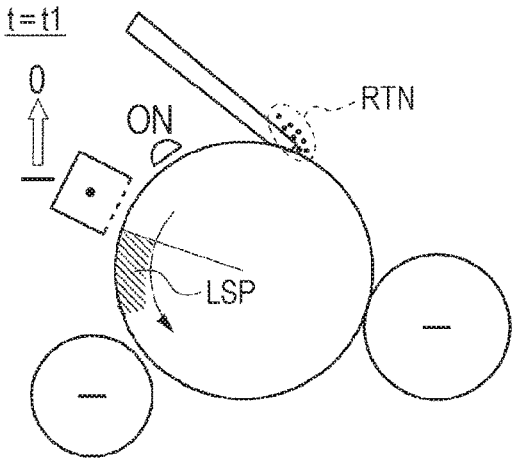

FIG. 4B illustrates the application stop of the charging bias. After the transfer completion time t0, the toner image termination LSP passes through the cleaning blade 27. During this passage, the blade 27 scrapes off the residual toner RTN from the termination LSP. Thereafter, the toner image termination LSP passes through the eraser 28. As a result, the charge remaining in the transfer trace of the toner image disappears from the surface of the photoreceptor. Furthermore, as illustrated in FIG. 4B, the toner image termination (surface portion) LSP faces the electrode 241 of the charging unit 24. At this time, discharge occurs between the electrode 241 and the termination LSP, and the termination LSP is charged. The control unit 202 assumes the time counting value t=t1 (hereinafter, referred to as "charging end time") indicating the time. When the time counting value t reaches the assumed value t1, application of the charging bias to the charging unit 24 is stopped. As a result, the toner image termination LSP becomes the portion (hereinafter, referred to as "charging termination") of the surface of the photoreceptor lastly charged by the discharge between the toner image termination LSP and the charging unit 24.

Figure 4C:
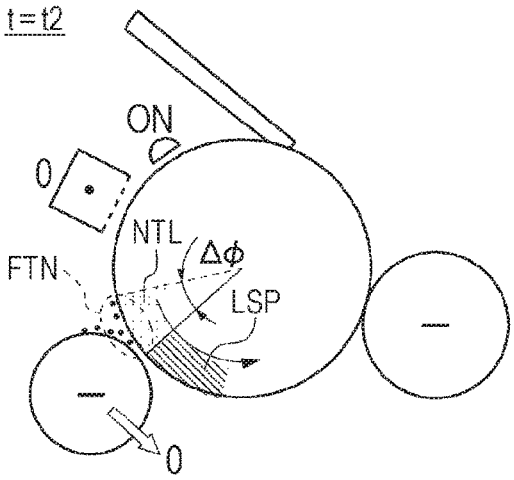

FIG. 4C illustrates the application stop of the developing bias and the adhesion of the fogging toner to the photoreceptor. After the charging end time t1, the charging termination LSP passes through the nip between the PC drum 22 and the developing roller 262. Since the charging termination LSP on the surface of the photoreceptor is charged by the discharge with the charging unit 24, toner does not adhere to the charging termination LSP even when passing through the nip. The control unit 202 assumes a time counting value t=t2 (hereinafter, referred to as "development end time") indicating the time at which the charging termination LSP reliably passes through the nip, and when the time counting value t reaches the assumed value t2, the application of the developing bias to the developing unit 26 is stopped. In accordance with this, the developing bias starts to return to the ground voltage from the value at the time of development. Strictly, the rotation of the PC drum 22 advances by the rotation angle Δφ during the period from the development end time t2 to the time when the development bias returns to the ground voltage, and the uncharged portion (hereinafter, referred to as "uncharged start end") NTL of the photoreceptor surface enters the nip immediately after the charging termination LSP. If the developing bias is sufficiently lower than the ground voltage at the time of entry, since the potential of the uncharged start end NTL is sufficiently higher than that of the developing roller 262, as illustrated in FIG. 4C, the fogging toner FTN adheres to the uncharged start end NTL.

Figure 4D:
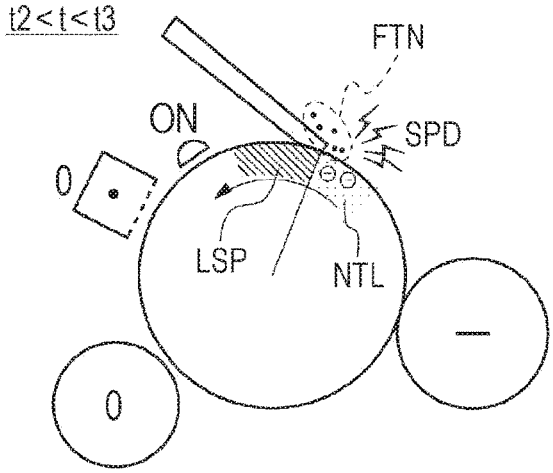

FIG. 4D illustrates the removal of the fogging toner FTN by the cleaning blade 27 and the charging of the photoreceptor accompanied by the peeling discharge SPD. After the development end time t2, the charging termination LSP and the uncharged start end NTL pass through the nip between the PC drum 22 and the transfer roller 23. During this passage, since the transfer bias is kept at the cleaning voltage and has an opposite polarity (negative polarity in FIG. 4D) to the transfer voltage, the fogging toner FTN does not move to the transfer roller 23. Thereafter, subsequent to the charging termination LSP, the uncharged start end NTL comes into contact with the cleaning blade 27. At this time, as illustrated in FIG. 4D, the fogging toner FTN is scraped off by the blade 27 and moves to the edge. Along with this movement, the electric charge having an opposite polarity (for example, positive polarity) to that of the fogging toner FTN is induced to the uncharged start end NTL. With this induction, if the potential difference between the edge of the blade 27 and the uncharged start end NTL exceeds the discharge start voltage even locally, the peeling discharge SPD occurs between both surfaces and the induced charge moves from the uncharged start end NTL to the edge. As a result, the uncharged start end NTL is charged to the same polarity (for example, negative polarity) as that of the fogging toner FTN.

Figure 4E:
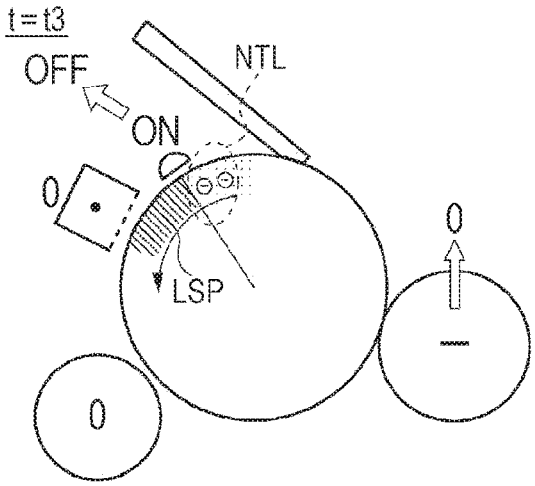

FIG. 4E illustrates the transition of the eraser 28 from ON to OFF. After passing through the cleaning blade 27, the charging termination LSP passes through a position facing the eraser 28. Since light is irradiated from the eraser 28 to the surface of the photoreceptor passing through this position, the electric charge disappears from the charged portion before the charging termination LSP. The control unit 202 assumes a time counting value t=t3 (hereinafter, referred to as "motor stop time") indicating this time. When the time counting value t reaches the assumed value t3, the control unit 202 causes the transfer unit 203 to stop the application of the transfer bias, causes the discharging unit 204 to turn off the LED of the eraser 28, and causes the driving unit 20D to stop the PC motor 20A. As a result, since the transmission of the rotational force from the PC motor 20A is stopped, the PC drum 22 continues to rotate by inertia after the motor stop time t3, but the PC motor 20A receives the braking force from the transmission mechanisms 20P, 22P and 20B and the cleaning blade 27 illustrated in FIG. 2A and its rotation decelerates.

At the time t3, generally, since the uncharged start end NTL has not yet reached the position facing the eraser 28, the eraser 28 is turned off before the uncharged start end NTL receives irradiation light from the eraser 28. Therefore, if the uncharged start end NTL is charged by the peeling discharge SPD between the uncharged start end NTL and the cleaning blade 27, the uncharged start end NTL remains charged even after the motor stop time t3. In this case, there is a high risk that the carrier moves and adheres to the uncharged start end NTL from the developing roller 262, while the PC drum 22 continues to rotate by inertia or when the PC motor 20A is subsequently started up.

[Adjustment of Parameters Necessary for Rising/Falling Sequences]

When the charged state of the uncharged start end NTL due to the peeling discharge SPD remains even after the motor stop time t3, there is a high risk of adherence of the carrier to the uncharged start end NTL. For the purpose of suppressing this risk, as it will be described below, the control unit 202 estimates the stop position of the charging termination LSP from the rotation angle of the PC drum 22 detected by the detecting unit 201, and adjusts the parameters necessary for the next rising sequence or falling sequence depending on the position.

Since the probability of occurrence of the peeling discharge SPD depends on the environmental humidity of the photoreceptor, the control unit 202 first determines the necessity of estimating the stop position of the charging termination LSP, depending on the environmental humidity. Specifically, the control unit 202 reads the measured value of the environmental humidity of the photoreceptor from the measuring unit 64 at the motor stop time t3, and compares the measured value with a threshold value. The threshold value indicates the environmental humidity when the probability of occurrence of the peeling discharge SPD is equal to an allowable upper limit. When the environmental humidity is equal to or higher than the threshold value, since the probability of occurrence of the peeling discharge SPD is lower than the allowable upper limit, the risk that the uncharged start end NTL remains charged even after the stop of the PC drum 22 may be negligible. Meanwhile, when the environmental humidity is less than the threshold, since the probability of occurrence of the peeling discharge SPD exceeds the allowable upper limit, its risk is not negligible. Therefore, in the latter case, the control unit 202 actually estimates the stop position of the charging termination LSP.

After the motor stop time t3, the control unit 202 causes the detecting unit 201 to count the output pulses of the rotary encoder 22R. This count value continues to increase, since the PC drum 22 continues to rotate by inertia during the period from the start of deceleration of the PC drum 22 with the stop of the PC motor 20A to the actual stop, that is, during the braking time of the PC drum 22. If the count value does not increase for a certain period of time or if the elapsed time from the counting start exceeds the upper limit of the braking time of the PC drum 22, the control unit 202 considers that "the PC drum 22 has stopped", and estimates the rotation angle of the PC drum 22 after the motor stop time t3, that is, the braking distance of the PC drum 22 from the count value of the detecting unit 201 at that time. For example, in the rotary encoder 22R illustrated in FIG. 2A, since the rotary plate 221 is coaxial with the PC drum 22, the product of the angle indicating the interval between the slits SLT and the count value is estimated as the braking distance of the PC drum 22.

Figure 4F:
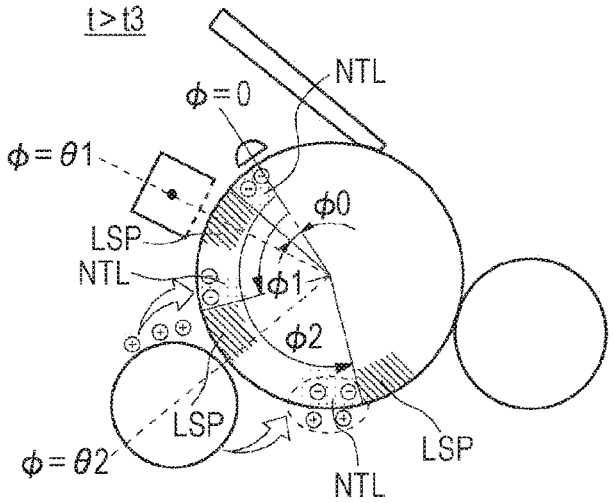

FIG. 4F illustrates typical stop positions $\varphi=\varphi\mathbf{0}$, $\varphi\mathbf{1}$ and $\varphi\mathbf{2}$ of the charging termination LSP (more precisely, a boundary between the charging termination LSP and the uncharged start end NTL). Referring to FIG. 4F, these stop positions $\varphi=\varphi\mathbf{0}$, $\varphi\mathbf{1}$ and $\varphi\mathbf{2}$ are indicated by the rotation angle of the PC drum 22 from the position, based on the position facing the eraser 28 as a reference position $\varphi=0°$. This is because the charging termination LSP needs to face the eraser 28 at the motor stop time t3 as illustrated in FIG. 4E.

The stop position $\varphi=\varphi\mathbf{0}$ closest to the reference position $\varphi=0°$ represents the range $0°\leq\varphi<\theta\mathbf{1}$ from the reference position to the position $\varphi=\theta\mathbf{1}$ facing the charging unit 24. When the charging termination LSP stops in this range, in the next rising sequence, the uncharged start end NTL first faces the charging unit 24 and is subjected to the charging process. Therefore, even if the uncharged start end NTL remains charged by the peeling discharge SPD during the falling sequence, the uncharged start end NTL reaches the developing roller 262 only after this charged state is eliminated by the charging bias. Therefore, the risk of adherence of carrier to the uncharged start end NTL is negligible.

The stop position $\varphi=\varphi\mathbf{1}$ which is next nearer to the reference position $\varphi=0°$ represents a range $\theta\mathbf{1}\leq\varphi<\theta\mathbf{2}$ from the position $\varphi=\theta\mathbf{1}$ facing the charging unit 24 to the nip $\varphi=\theta\mathbf{2}$ between the PC drum 22 and the developing roller 262. When the charging termination LSP stops in this range, since the uncharged start end NTL does not reach the nip $\varphi=\theta\mathbf{2}$ in the immediately preceding falling sequence, even if the NTL remains charged by the peeling discharge SPD, the risk of adherence of carrier to the NTL is negligible. However, in the next rising sequence, since the uncharged start end NTL enters the nip $\varphi=\theta\mathbf{2}$ earlier than the charging process, if the NTL remains charged by the peeling discharge SPD in the immediately preceding falling sequence, there is a high risk of adherence of carrier to the NTL.

The stop position $\varphi=\varphi\mathbf{2}$ farthest from the reference position $\varphi=0°$ represents the range $\theta\mathbf{2}\leq\varphi<360°$ from the nip $\varphi=\theta\mathbf{2}$ between the PC drum 22 and the developing roller 262 to the reference position $\varphi=360°$. When the charging termination LSP stops in this range, the uncharged start end NTL has already passed through the nip $\varphi=\theta\theta\mathbf{2}$ in the immediately preceding falling sequence. Therefore, if the uncharged start end NTL is charged by the peeling discharge SPD, there is a high risk that carriers have already adhered to the uncharged start end NTL when passing through the nip $\varphi=\theta\mathbf{2}$. Meanwhile, in the next rising sequence, the uncharged start end NTL reaches the developing roller 262 only after passing through the charging unit 24. Therefore, at the startup of the rising sequence, even if the charge amount remains at the uncharged start end NTL, the risk of adherence of new carrier to NTL is negligible.

As described above, the risk of adherence of carrier to the uncharged start end NTL varies, depending on the stop of charging termination LSP at one position of the three stop positions $\varphi=\varphi\mathbf{0}$, $\varphi\mathbf{1}$ and $\varphi\mathbf{2}$. Therefore, the control unit 202 adjusts the parameters necessary for the next rising sequence or the falling sequence in different manners for each of the stop positions $\varphi=\varphi\mathbf{0}$, $\varphi\mathbf{1}$, and $\varphi\mathbf{2}$ of the charging termination LSP as follows.

—Stop Position $\varphi=\varphi 0$—

This stop position $\varphi=\varphi 0$ falls within from the reference position $\varphi=0°$ to the position $\varphi=\theta 1$ facing the charging unit 24: $0° \leq \varphi 0 < \theta 1$. In this case, even if the uncharged start end NTL remains charged even after the falling sequence, the risk of adherence of carriers to the NTL in the next rising sequence is negligible. Therefore, when the braking distance $\varphi$ of the PC drum 22 estimated from the count value of the detecting unit 201 falls within this range of $0° \leq \varphi < \theta 1$, the control unit 202 maintains the parameters necessary for the rising sequence and the falling sequence at default values.

—Stop Position $\varphi=\varphi 1$—

Figure 5A:
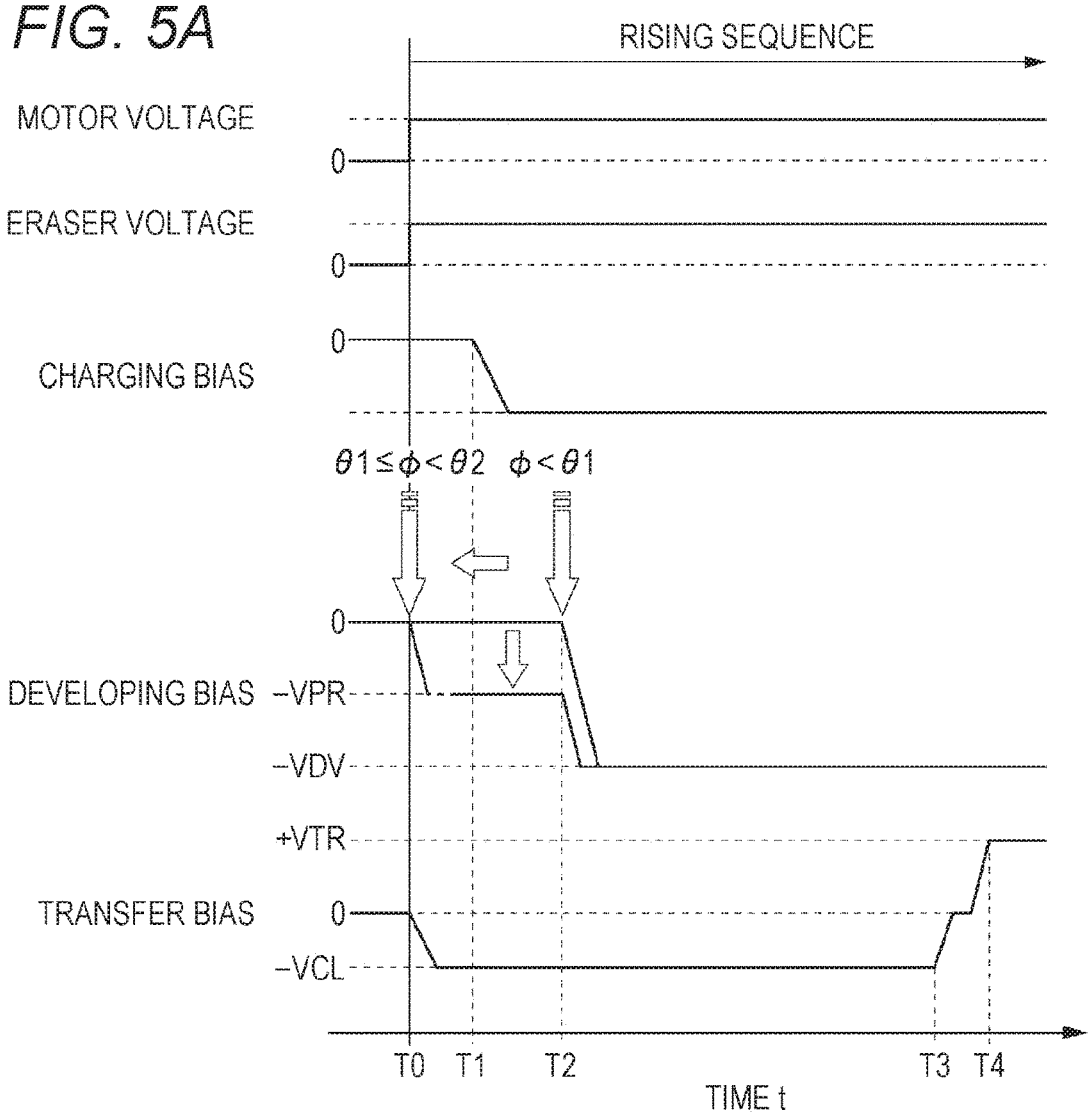
FIG. 5A is a timing chart of voltage applied to each element of the unit in the rising sequence of the photoreceptor unit illustrated in FIG. 1C.

FIG. 5A is a timing chart of voltage applied to the elements of the photoreceptor unit 20U in the rising sequence. In accordance with a startup instruction of a new job process from the main control unit 60, the control unit 202 starts up the elements of the photoreceptor unit 20U, that is, the driving unit 20D, the charging unit 24, the developing unit 26, the transfer unit 203 and the discharging unit 204 in accordance with the next rising sequence. Specifically, the control unit 202 applies drive voltages to each unit in the following order illustrated in FIG. 5A. 1. Application of the transfer bias is started, and its value is lowered to the cleaning voltage −VCL. At this time T0 (hereinafter, referred to as "motor startup time"), the PC motor 20A is further started up and the eraser 28 is turned on. 2. The application of the charging bias is started at a time T1 (hereinafter, referred to as "charging start time") when the time necessary for the rotational speed of the PC motor 20A to reach the target value has elapsed from the motor startup time T0. 3. Application of the developing bias is started at a time T2 (hereinafter, referred to as "developing start time") when the surface portion of the charged photoreceptor charged by the charging unit 24 starts to enter the nip between the PC drum 22 and the developing roller 262, and the developing bias is lowered to the target value −VDV before the surface portion actually starts to enter the nip. As a result, carriers do not adhere after the surface portion. 4. A time T4 (hereinafter, referred to as "transfer start time") at which the time required for the feeding unit 10 to finish conveyance of the first sheet to be processed from the sheet feeding cassette 11 to the timing roller 21 has elapsed from the motor startup time T0, the transfer bias is raised from the cleaning voltage −VCL to the transfer voltage +VTR. By keeping the transfer bias at the cleaning voltage −VCL up to the time T3 (hereinafter, referred to as "cleaning end time") at which the rising is started, even when the fogging toner adheres to the surface of the photoreceptor at the nip between the PC drum 22 and the developing roller 262, the toner is scraped off by the cleaning blade 27 without moving to the transfer roller 23.

The parameters required for such a rising sequence include startup timings of each unit of the driving unit 20D, the charging unit 24, the developing unit 26, the transfer unit 203, and the discharging unit 204, specifically, the interval between the respective timings T0, T1, T2 , T3 and T4 illustrated in FIG. 5A, and the target values −VDV, −VCL and +VTR of each bias. When the stop position $\varphi$ of the charging termination LSP falls within from the reference position $\varphi=0°$ to the position $\varphi=\theta 1$ facing the charging unit 24: $0° \leq \varphi < \theta 1$ or when the stop position $\varphi$ falls within from the nip $\varphi=\theta 2$ between the PC drum 22 and the developing roller 262 to the reference position $\varphi=360°=0°$: the range $\theta 2 \leq \varphi < 360°$, the control unit 202 maintains these parameters at the values illustrated in FIG. 5A, that is, the default values. Meanwhile, when the stop position $\varphi$ of the charging termination LSP falls within from the position $\varphi=\theta 1$ facing the charging unit 24 to the nip $\varphi=\theta 2$ between the PC drum 22 and the developing roller 262: $\theta 1 \leq \varphi < \theta 2$, the control unit 202 changes the startup timing of the developing unit 26 and the target value of the developing bias among these parameters as follows.

Figure 5B:
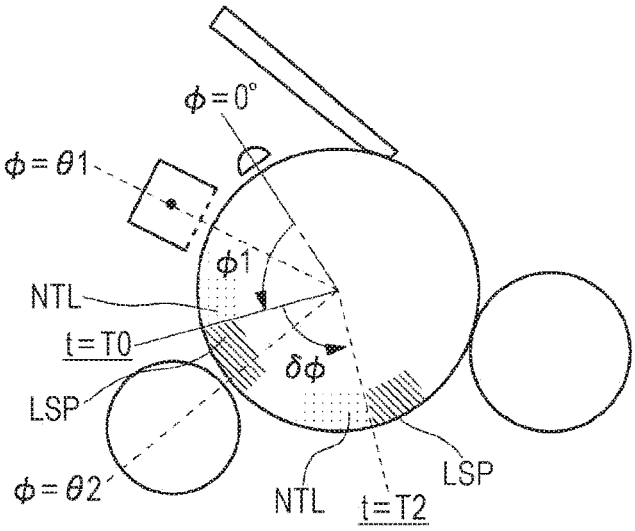
FIG. 5B is a schematic diagram illustrating the position of the charging termination at the time t=T0 and T2 illustrated in FIG. 5A.

FIG. 5B is a schematic diagram illustrating the positions $\varphi=\varphi 1$ and $\varphi 1+\delta\varphi$ of the charging termination LSP at the motor startup time T0 and the developing start time T2. Referring to FIG. 5B, the boundary between the charging termination LSP and the uncharged start end NTL moves from the stop position $\varphi=\varphi 1$ to the rotation angle $\delta\varphi$ during the period from the motor startup time T0 to the developing start time T2. Therefore, the uncharged start end NTL passes through the nip $\varphi=\theta 2$ between the PC drum 22 and the developing roller 262 earlier than the charging unit 24. If the uncharged start end NTL remains charged in the immediately preceding falling sequence, there is a high risk of adherence of carriers to the NTL during passage through the nip $\varphi=\theta 2$. In order to suppress this risk, it is only necessary to maintain the developing roller 262 at a lower potential than the uncharged start end NTL by application of the negative developing bias (hereinafter, referred to as "carrier blocking voltage") during the passage. Since the charge amount due to the peeling discharge SPD is generally smaller than the charge amount of the charging unit 24, the carrier blocking voltage may be closer to the ground voltage 0V than the value −VDV at the time of development of the developing bias.

When the braking distance $\varphi$ of the PC drum 22 estimated from the count value of the detecting unit 201 falls within $\theta 1 \leq \varphi < \theta 2$, as illustrated in FIG. 5A, the control unit 202 advances the application start of the developing bias from the developing start time T2 to motor startup time T0. Further, the control unit 202 sets the target value of the developing bias up to the developing start time T2 to the carrier blocking voltage −VPR (≥−VDV). As a result, the developing bias is already maintained at the carrier blocking voltage −VPR at the time when the charging termination LSP enters the nip between the PC drum 22 and the developing roller 262. Even if the uncharged start end NTL is still charged in the immediately preceding falling sequence, since its potential is lower than the potential −VPR of the developing roller 262, the carriers do not adhere to the uncharged start end NTL.

—Stop Position $\varphi=\varphi 2$—

Figure 6A:
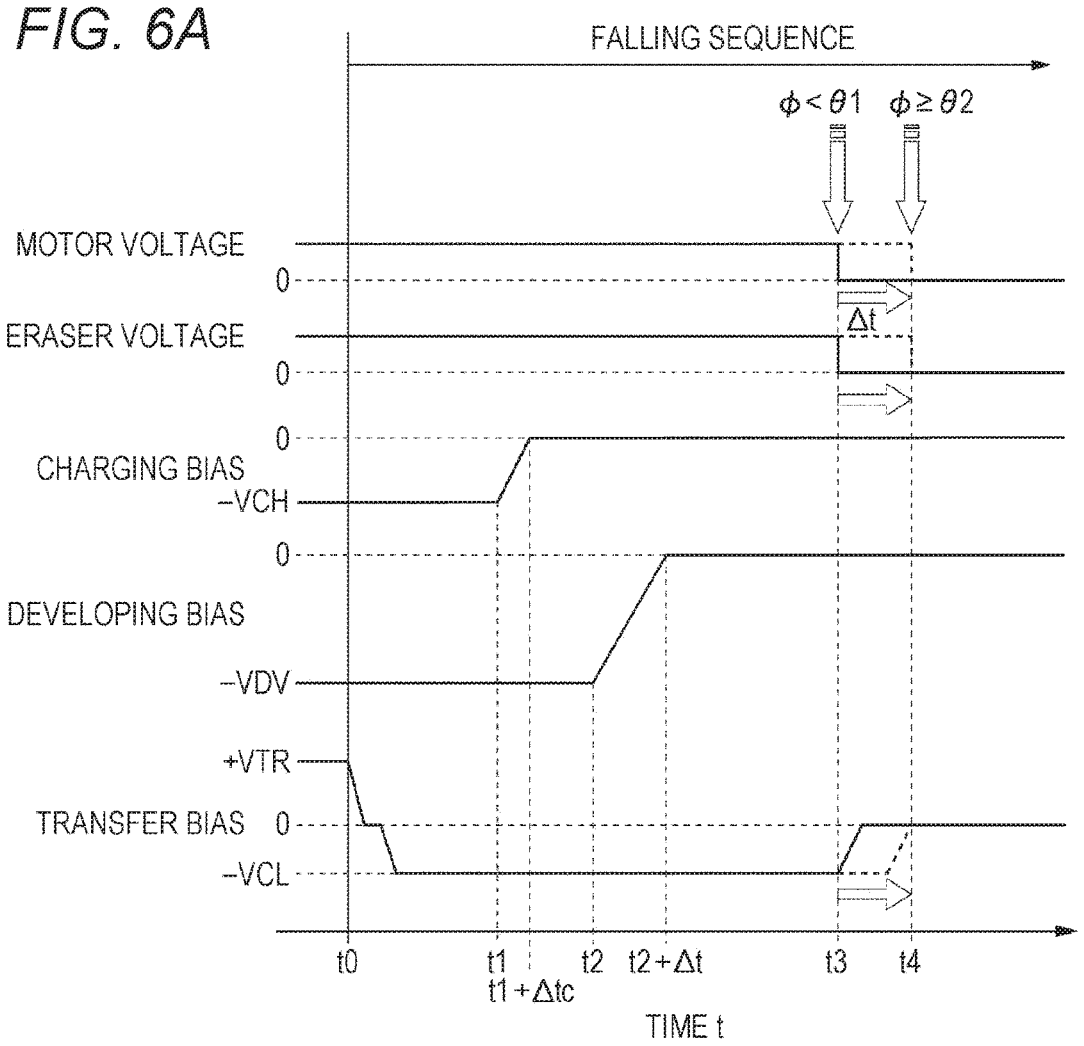
FIG. 6A is a timing chart of voltage applied to each element of the photoreceptor unit in the falling sequence illustrated in FIGS. 4A to 4F.

FIG. 6A is a timing chart of voltages applied to each element of the photoreceptor unit 20U in the falling sequence. In accordance with an end instruction of the job process from the main control unit 60, the control unit 202 stops the application of the drive voltage to the elements 20D, 24, 26, 203 and 204 of the photoreceptor unit 20U in the following order illustrated in FIG. 6A. 1. At the transfer completion time t0, the polarity inversion of the transfer bias, that is, the drop from the transfer voltage +VTR to the cleaning voltage −VCL is started. 2. Application of the charging bias is stopped at the charging end time t1. 3. Application of the developing bias is stopped at the development end time t2. 4. Application of the transfer bias is stopped at the motor stop time t3, the eraser 28 is turned off, and the PC motor 20A is stopped.

The parameters necessary for such a falling sequence include the stop timing of each unit of the driving unit 20D, the charging unit 24, the developing unit 26, the transfer unit 203, and the discharging unit 204, specifically, the intervals of each time t0, t1, t2 and t3 illustrated in FIG. 6A. When the stop position $\varphi$ of the charging termination LSP falls within from the reference position $\varphi=0°$ to the nip $\varphi=\theta 2$ between the PC drum 22 and the developing roller 262: $0° \leq \varphi < \theta 2$, the control unit 202 may maintain the parameters at the values illustrated in FIG. 6A, that is, the default values. Meanwhile, when the stop position $\varphi$ falls within from the nip $\varphi = \theta 2$ to the reference position $\varphi = 360° \equiv 0°$: $\theta 2 \leq \varphi < 360°$, the control unit 202 changes the stop timings of the driving units 20D, the transfer unit 203, and the discharging unit 204 as follows.

Figure 6B:
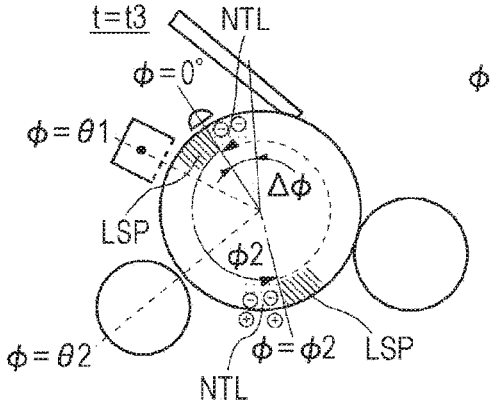
FIG. 6B is a schematic diagram illustrating the position of the charging termination at the time t=t3 illustrated in FIG. 6A and the subsequent stop position.

FIG. 6B is a schematic diagram illustrating the position $\varphi = 0$ of the charging termination LSP at the motor stop time t3 and the subsequent stop position $\varphi = \varphi 2$. Referring to FIG. 6B, during the braking time of the PC drum 22 after the motor stop time t3, the boundary between the charging termination LSP and the uncharged start end NTL changes from the reference position $\varphi = 0°$ by the braking distance $\varphi 2$ of the PC drum 22. During the braking time, the uncharged start end NTL passes through the nip $\varphi = \theta 2$ between the PC drum 22 and the developing roller 262, without receiving irradiation light from the eraser 28. If the uncharged start end NTL is charged by the peeling discharge SPD, there is a high risk of adherence of carriers to the NTL during passage through the nip $\varphi = \theta 2$. It is not possible to prevent this adhesion in advance or to remove the adhered carriers. However, in the next falling sequence, it is possible to prevent new carriers from adhering to the uncharged start end NTL. That is, the stop timing of the PC motor 20A and the eraser 28 may be delayed, until the uncharged start end NTL receives irradiation light from the eraser 28. Specifically, the control unit 202 delays the motor stop time t3 until the time t4 illustrated in FIG. 6A. The time difference $\Delta t = t4 - t3$ is set to be equal to the time required for the developing bias to return from the value −VDV during development to the ground voltage 0 V. As is apparent from FIG. 4C, the rotation angle $\Delta\varphi$ of the PC drum 22 at this time $\Delta t$ is equal to the range of the uncharged start end NTL to which the fogging toner FTN adheres in the immediately preceding falling sequence.

Figure 6C:
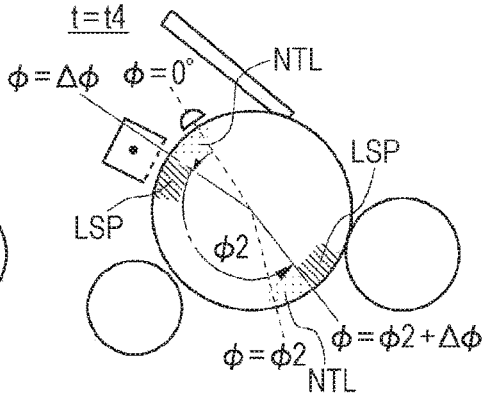
FIG. 6C is a schematic diagram illustrating the position of the charging termination at the time t=t4 illustrated in FIG. 6A and the subsequent stop position.

FIG. 6C is a schematic diagram illustrating the position $\varphi = \Delta\varphi$ of the charging termination LSP at a new motor stop time $t4 = t3 + \Delta t$ and the subsequent stop position $\varphi = \Delta\varphi + \varphi 2$. Referring to FIG. 6C, at the new motor stop time t4, the charging termination LSP will advance by the rotation angle $\Delta\varphi$ from the reference position, that is, the position $\varphi = 0°$ opposite to the eraser 28. As indicated by the thick broken line in FIG. 6C, the application stop of the drive voltage to the eraser 28 with the delay of the motor stop time $t3 \rightarrow t4$, that is, turning off of the eraser 28 is also delayed. Therefore, after the original time t3, subsequent to the charging termination LSP, the range of the rotation angle $\Delta\varphi$ of the uncharged start end NTL also receives the irradiation light from the eraser 28. By the irradiation light, the electric charge disappears from the uncharged start end NTL. Even if the uncharged start end NTL is in a charged state at the original motor stop time t3 by the peeling discharge SPD, the charged state is eliminated at a new motor stop time t4. Thus, in the falling sequence, adhesion of the carrier to the uncharged start end NTL is prevented.

In the falling sequence, since the braking distance of the PC drum 22 is considered to be substantially equal to the value $\varphi 2$ in the immediately preceding falling sequence, the stop position of the charging termination LSP will advance by the rotation angle $\Delta\varphi$ from the position $\varphi 2$ in the immediately preceding falling sequence: $\varphi = \varphi 2 + \Delta\varphi$. Since the rotation angle $\Delta\varphi$ is generally sufficiently smaller than the braking distance $\varphi 2$, the stop position of the charging termination LSP does not reach the position $\theta 1$ facing the charging unit 24. Therefore, even if the uncharged start end NTL remains charged, in the next rising sequence, the uncharged start end NTL reaches the developing roller 262 only after passing through the charging unit 24. Therefore, since the risk of the adherence of carrier to the uncharged start end NTL is negligible, the control unit 202 maintains the necessary parameters at the default values in the subsequent rising sequence.

In the falling sequence after the motor stop time is delayed, the control unit 202 maintains the motor stop time at the delayed value t4. As a result, even in any subsequent falling sequence, subsequent to the charging termination LSP, the uncharged start end NTL passes through the developing unit 26 only after receiving the irradiation light from the eraser 28. Therefore, the risk of adherence of carriers to the uncharged start end NTL is negligible.

[Flow of Process Control in Falling Sequence]

Figure 7:
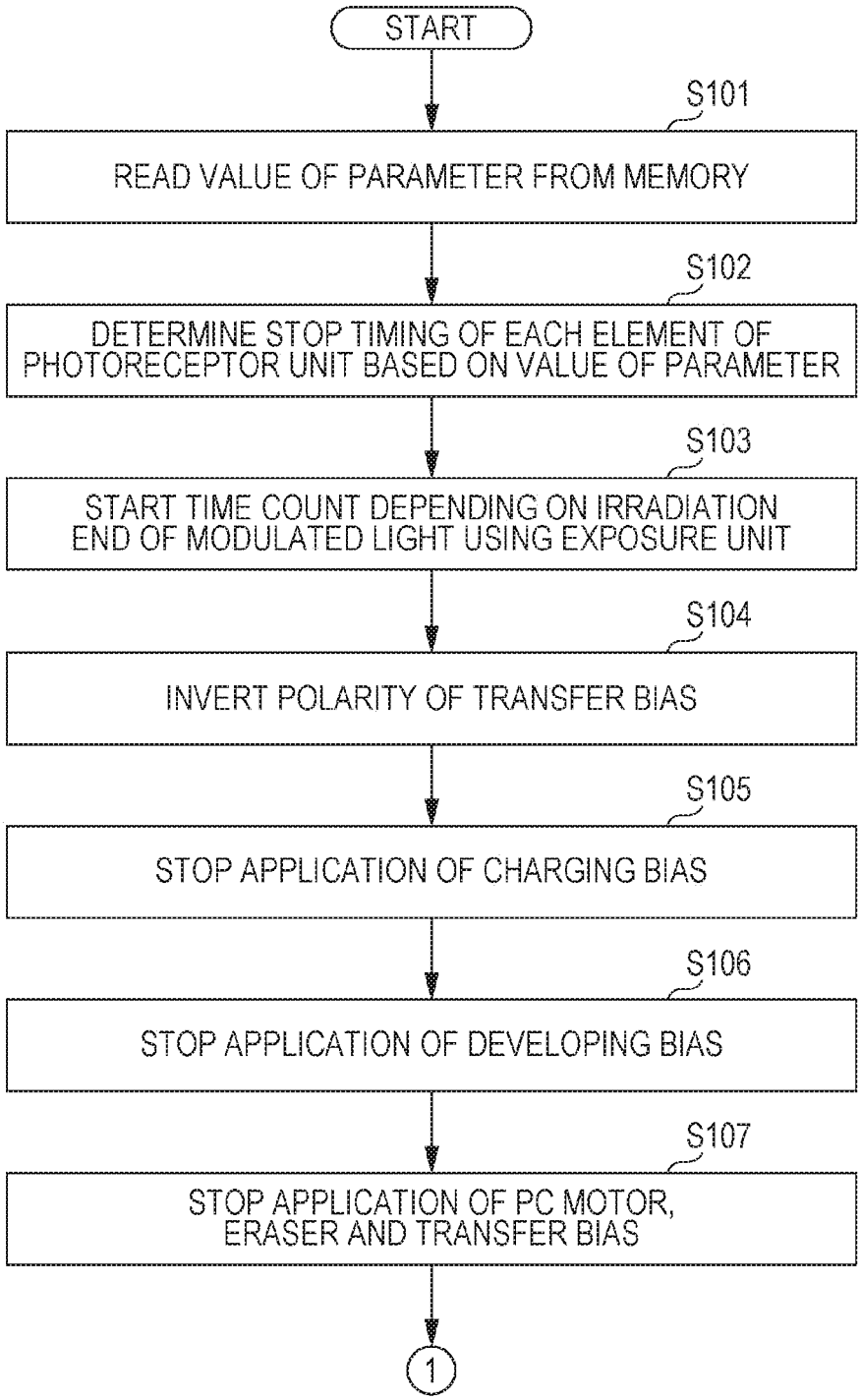
FIG. 7 is the first half of a flowchart of process control in the falling sequence illustrated in FIGS. 4A to 4F.

FIGS. 7 and 8 are flowcharts of a process control in the falling sequence. This process is started in accordance with the end instruction of the job process from the main control unit 60.

In step S101, the control unit 202 reads the value of the parameters necessary for the falling sequence from the built-in memory. Thereafter, the process proceeds to step S102.

In step S102, the control unit 202 determines the stop timings of the driving unit 20D, the charging unit 24, the developing unit 26, the transfer unit 203 and the discharging unit 204, based on the values read in step S101. Specifically, the control unit 202 assumes the respective times t0, t1, t2 and t3 illustrated in FIG. 6A. Thereafter, the process proceeds to step S103.

In step S103, as the exposure unit 25 finishes the irradiation of the laser beam modulated with the image data of the process object, the control unit 202 starts to measure the elapsed time t from that time point. Thereafter, the process proceeds to step S104.

In step S104, in accordance with the time counting value t reaching the transfer completion time t0, the control unit 202 causes the transfer unit 203 to start the polarity inversion of the transfer bias. Thereafter, the process proceeds to step S105.

In step S105, in accordance with the time counting value t reaching the charging end time t1, the control unit 202 stops the application of the charging bias to the charging unit 24. Thereafter, the process proceeds to step S106.

In step S106, in accordance with the time counting value t reaching the development end time t2, the control unit 202 stops the application of the developing bias to the developing unit 26. Thereafter, the process proceeds to step S107.

In step S107, in accordance with the time counting value t reaching the motor stop time t3 or t4, the control unit 202 causes the transfer unit 203 to stop the application of the transfer bias, causes the discharging unit 204 to turn on the LED of the eraser 28, and causes the driving unit 20D to stop the PC motor 20A. Thereafter, the process proceeds to step S201.

In step S201, the control unit 202 checks whether or not the motor stop time read in step S101 is equal to the default value t3. If the motor stop time is equal to the default value t3, the process proceeds to step S202, otherwise the process proceeds to step S208.

In step S202, since the motor stop time is equal to the default value t3, the stop position of the charging termination LSP does not exceed the nip $\varphi = \theta 2$ between the PC drum 22 and the developing roller 262 until the previous falling sequence. The control unit 202 reads the measured value of the environmental humidity of the photoreceptor from the measuring unit 64 at the motor stop time t3, and checks whether the measured value is less than the threshold value. If the measured value is less than the threshold value, the process proceeds to step S203, and if the measured value is equal to or greater than the threshold value, the process proceeds to step S208.

In step S203, since the environmental humidity of the photoreceptor is less than the threshold value, the probability of occurrence of the peeling discharge SPD exceeds the allowable upper limit. That is, the risk of adherence of carriers to the uncharged start end NTL is not negligible. Therefore, after the motor stop time t3, the control unit 202 causes the detecting unit 201 to count the output pulses of the rotary encoder 22R. Thereafter, the process proceeds to step S204.

In step S204, the control unit 202 determines whether or not the PC drum 22 has stopped from the count value of the output pulse of the rotary encoder 22R. Specifically, if the count value does not increase for a certain period of time or if the elapsed time from the start of counting exceeds the upper limit of the braking time of the PC drum 22, the control unit 202 determines that "the PC drum 22 has stopped". If the PC drum 22 is stopped, the process proceeds to step S205, and if the PC drum 22 is not stopped, the process repeats step S204.

In step S205, since the PC drum 22 will be stopped, the control unit 202 first estimates the rotation angle of the PC drum 22 after the motor stop time t3 from the count value of the detecting unit 201 at that time, that is, the braking distance of the PC drum 22. Next, the control unit 202 sets the position φ advanced from the reference position φ=0° facing the eraser 28 by the estimated value at the stop position of the charging termination LSP. Thereafter, the process proceeds to step S206.

In step S206, the control unit 202 checks whether or not the stop position φ of the charging termination LSP set in step S205 falls within 0°≤φ<θ1 from the reference position φ=0° to the position φ=θ1 facing the charging unit 24. If the stop position φ falls within the range, the process proceeds to step S207, and if not, the process proceeds to step S208.

In step S207, the control unit 202 checks whether the stop position φ of the charging termination LSP falls within θ1≤φ<θ2 from the position φ=θ1 facing the charging unit 24 to the nip φ=θ2 between the PC drum 22 and the developing roller 262. If the stop position φ falls within the range, the process proceeds to step S209, and if not, the process proceeds to step S210.

In step S208, one of the following conditions is satisfied. (1) The motor stop time is different from the default value t3. (2) The measured value of the environmental humidity of the photoreceptor is equal to or greater than the threshold value. (3) The stop position φ of the charging termination LSP falls within 0°≤φ<θ1 from the reference position φ=0° to the position φ=θ1 facing the charging unit 24. When the condition (2) is satisfied, the probability of occurrence of the peeling discharge SPD is sufficiently low. If the conditions (1) and (3) are satisfied, even if the uncharged start end NTL remains charged by the peeling discharge SPD during the falling sequence, the risk of the adherence of carrier to the uncharged start end NTL is negligible. Therefore, the control unit 202 sets the parameters necessary for the next rising sequence to the default values, and maintains the parameters required for the next falling sequence at the current value. After that, the process ends.

In step S209, the stop position φ of the charging termination LSP falls within the range from the position φ=θ1 facing the charging unit 24 to the nip φ=θ2 between the PC drum 22 and the developing roller 262: θ1≤φ<θ2. In this falling sequence, if the uncharged start end NTL remains charged by the peeling discharge SPD, there is a high risk of adherence of carriers to the uncharged start end NTL in the next rising sequence. Therefore, the control unit 202 shortens the application start of the developing bias among the parameters necessary for the next rising sequence from the developing start time T2 to the motor startup time T0, and sets the target value of the development bias up to the developing start time T2 at the carrier blocking voltage −VPR. After that, the process ends.

In step S210, the stop position φ of the charging termination LSP falls within from the nip φ=θ2 between the PC drum 22 and the developing roller 262 to the reference position φ=360°≡0°: θ2≤φ<360°. In this falling sequence, if the uncharged start end NTL is still charged by the peeling discharge SPD, there is a high risk that carriers already adhere to the uncharged start end NTL. Therefore, the control unit 202 delays the motor stop time from the default value t3 among the parameters necessary for the next falling sequence by the time Δt necessary for the developing bias to return from the developing value −VDV to the ground voltage 0 V. After that, the process ends.

[Advantages of Embodiment]

In the printer 100 according to the embodiment of the present invention, the detecting unit 201 detects the rotation angle of the PC drum 22 of the braking time in the falling sequence, and the control unit 202 estimates the stop position φ of the charging termination LSP from the rotation angle. The control unit 202 further adjusts parameters necessary for the next rising sequence or falling sequence, depending on the stop position φ. As a result, adhesion of carriers to the photoreceptor in each sequence is effectively suppressed. In this way, the printer 100 can achieve a prolonged maintenance of high image quality and a long lifetime of the photoreceptor.

[Modified Example]

(A) The image forming apparatus 100 illustrated in FIGS. 1A to 1C is a monochrome laser printer. In addition, the image forming apparatus according to the embodiment of the present invention may be a color laser printer, a facsimile, a copying machine, or a composite machine (MFP). For example, in a color laser printer of a direct transfer type, four developing units having the same structure as the developing unit 26 are continuously disposed around the PC drum 22 illustrated in FIG. 1B. These developing units actualize the toner images of yellow (Y), magenta (M), cyan (C) and black (K) one by one to overlap on the same part of the surface of the photoreceptor. The invention can be applied in the same manner as in the above embodiment, by considering the whole of these four developing units as the developing unit 26 of the monochrome laser printer 100.

The invention can also be applied to a color laser printer of an intermediate transfer type. In the intermediate transfer type, the toner image is transferred from the photoreceptor to the sheet via the intermediate transfer member.

Figure 9A:
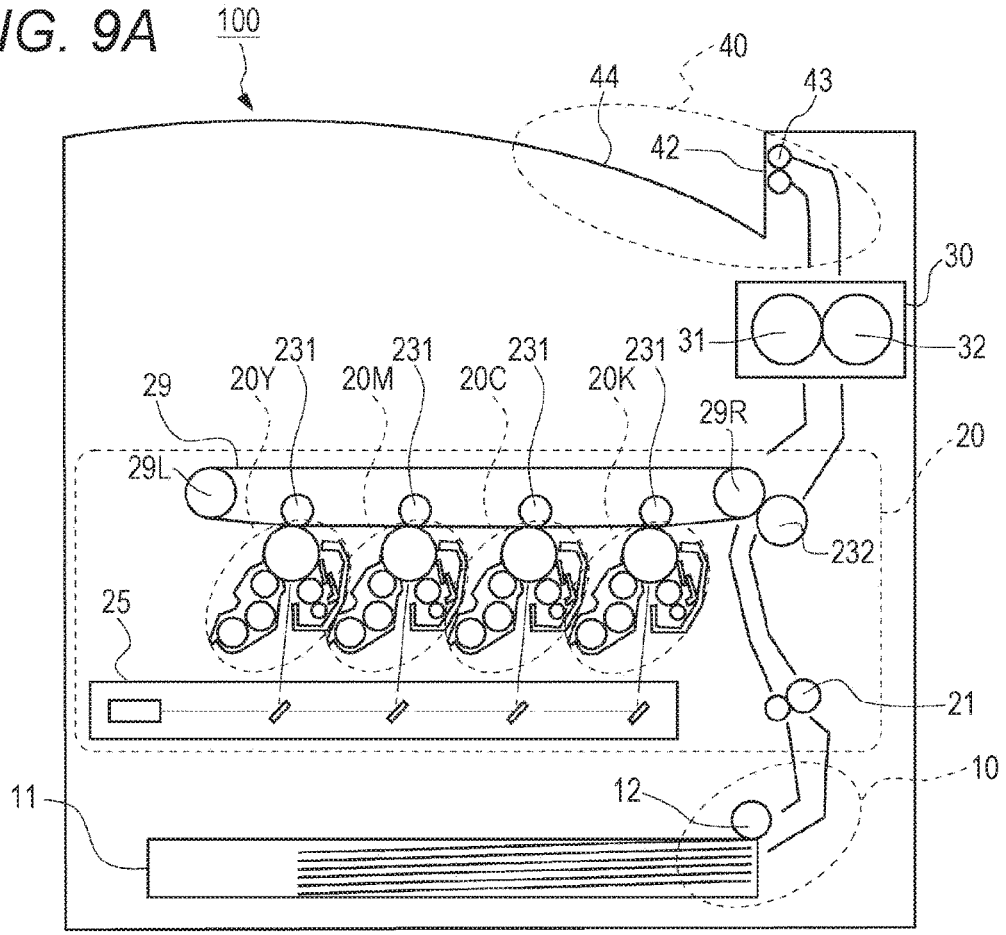
FIG. 9A is a schematic sectional view of a modified example of the image forming apparatus taken along the line b-b illustrated in FIG. 1A.

FIG. 9A is another example of a schematic cross-sectional view of the printer 100 taken along a line b-b illustrated in FIG. 1A. In this example, the printer 100 is a color laser printer of the intermediate transfer type, and the image forming unit 20 forms a color toner image on the sheet SH2 sent from the feeding unit 10, using the photoreceptor units 20Y, 20M, 20C and 20K arranged in a tandem manner. Specifically, an intermediate transfer belt 29 is wound around the two pulleys 29L and 29R in the image forming unit 20. Between these pulleys 29L and 29R, four photoreceptor units 20Y to 20K and four primary transfer rollers 231 are paired one by one, and the intermediate transfer belt 29 is interposed between the photoreceptor units 20Y to 20K and the primary transfer rollers 231. The intermediate transfer belt 29 passes through a nip between each of the photoreceptor units 20Y to 20K and the primary transfer roller 231 by the rotational force received from both pulleys 29L and 29R. Each of the photoreceptor units 20Y to 20K forms a toner image of one color of Y, M, C and K on the surface portion, when the same surface portion of the intermediate transfer belt 29 passes through a gap between the photoreceptor units and the facing primary transfer roller 231. As a result, four color toner images overlap the surface portion thereof to form one color toner image. The pulley 29R on one side forms a nip with a secondary transfer roller 232 with the intermediate transfer belt 29 interposed therebetween. The timing roller 21 sends the sheet SH2 to the nip in accordance with the timing when the color toner image passes through the nip. As a result, the toner image is transferred from the intermediate transfer belt 29 to the sheet SH2.

Figure 9B:
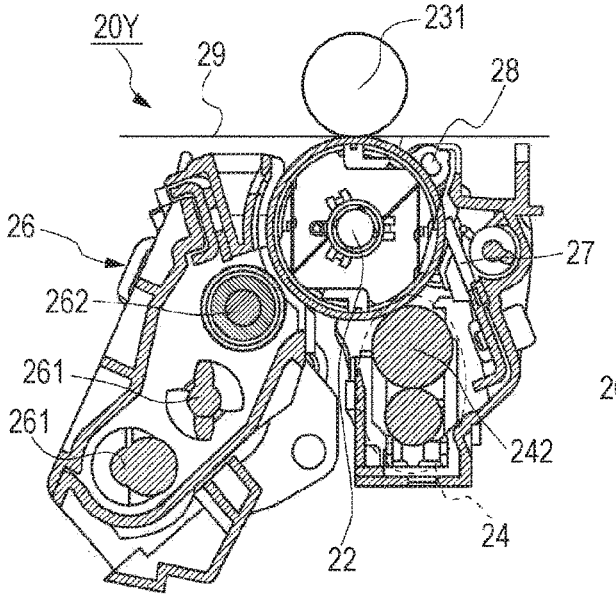
FIG. 9B is an enlarged view of the photoreceptor unit illustrated in FIG. 9A.

FIG. 9B is an enlarged view of the photoreceptor unit 20Y, one of the photoreceptor units 20Y to 20K. Other photoreceptor units 20M, 20C and 20K also include the same structure. Referring to FIG. 9B, in the photoreceptor unit 20Y, similarly to the photoreceptor unit 20U illustrated in FIG. 1B, a charging unit 24, a developing unit 26, a cleaning blade 27 and an eraser 28 are disposed around the PC drum 22. When the PC drum 22 makes one rotation (in the clockwise direction CLW in FIG. 9B), each surface portion of the photoreceptor faces the surrounding functional units 24, 25, 26, 231, 28 and 27 in order. Hereinafter, elements different from the elements illustrated in FIG. 1B will be described, and similar elements will be described with reference to the elements illustrated in FIG. 1B.

The charging unit 24 includes a charging roller 242. The charging roller 242 is a cylindrical member in which the circumference of a metallic core metal is surrounded by a conductive resin, and is rotatably supported around a central axis (an axis penetrating the center of the circular cross section of the charging roller 242 perpendicularly to the sheet plane in FIG. 9B). Since the outer circumferential surface of the charging roller 242 comes into contact with the outer circumferential surface of the PC drum 22, the charging roller 242 is driven to rotate by the rotation of the PC drum 22. The charging unit 24 applies the charging bias to the core metal of the charging roller 242 to cause a discharge in the gap between the charging roller 242 and the PC drum 22. This electric discharge negatively charges the surface portion of the photoreceptor facing the gap.

With the rotation of the PC drum 22, the toner image actualized by the developing unit 26 moves to the nip between the PC drum 22 and the primary transfer roller 231, and is transferred into the surface portion of the intermediate transfer belt 29 simultaneously passing through the same nip from the surface of the PC drum 22, by the transfer bias applied to the primary transfer roller 231.

The surface portion of the photoreceptor including the transfer trace of the toner image receives the irradiation light from the eraser 28 with the rotation of the PC drum 22. As a result, the surface portion is discharged. The surface portion further comes into contact with the cleaning blade 27 with the rotation of the PC drum 22. The blade 27 scrapes off the toner remaining in the transfer trace of the toner image from the surface portion. Thereafter, the surface portion faces the charging unit 24 again with the rotation of the PC drum 22.

Figure 9C:
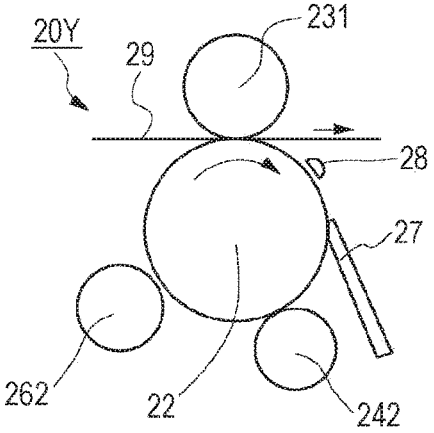
FIG. 9C is a schematic diagram of the photoreceptor unit illustrated in FIG. 9B.

FIG. 9C is a schematic diagram of the photoreceptor unit 20Y illustrated in FIG. 9B. The photoreceptor unit 20Y illustrated in FIG. 9C is different from the photoreceptor unit 20U illustrated in FIG. 1C only in that the eraser 28 is closer to the primary transfer roller 231 than the cleaning blade 27. With this difference, in the former photoreceptor unit 20Y, unlike the latter photoreceptor unit 20U, the charging termination LSP faces the eraser 28 before passing through the cleaning blade 27. The control unit 202 assumes this time as the motor stop time. At this time, the control unit 202 stops the application of the transfer bias, turns off the LED of the eraser 28, and stops the PC motor 20A. Therefore, the uncharged start end NTL does not receive the irradiation light from the eraser 28. Meanwhile, since the PC drum 22 continues to rotate by inertia even after the motor stop time, the charging termination LSP and the uncharged start end NTL pass through the edge of the cleaning blade 27. As a result, the fogging toner FTN is removed by the blade 27. If the uncharged start end NTL is charged by the peeling discharge SPD at this time, the uncharged start end NTL remains charged even after the stop of the PC drum 22. In this way, similarly to the photoreceptor unit 20U illustrated in FIG. 1C, even in the photoreceptor unit 20Y illustrated in FIG. 9C, while the PC drum 22 continues to rotate by inertia at the uncharged start end NTL, or when the PC motor 20A is subsequently started up, there is a high risk of adherence of carriers from the developing roller 262. Therefore, similarly to the aforementioned embodiment, the control unit 202 adjusts parameters necessary for the next rising sequence or the falling sequence depending on the stop position of the charging termination LSP. Thus, it is possible to effectively suppress adhesion of carriers to the surface of the photoreceptor.

(B) The photoreceptor illustrated in FIG. 1B covers the outer circumferential surface of the drum 22. In addition, the photoreceptor may cover the outer circumferential surface of the belt. Like the drum 22, the belt is surrounded by a charging unit, a developing unit, a cleaning blade and an eraser, and each surface portion of the photoreceptor sequentially faces the functional units when the belt makes one rotation.

(C) The charging bias, the developing bias, and the transfer bias may be opposite to the polarities illustrated in FIGS. 4A to 4F, FIGS. 5A and 5B, and FIGS. 6A to 6C. In this case, the developing unit 26 may positively charge the toner.

(D) The transmission mechanism between the PC drum 22 and the PC motor 20A illustrated in FIG. 2A includes one belt 20B and two pulleys 20P and 22P. In addition, the transmission mechanism may include two or more belts and three or more pulleys, or may be a structure in which rotational force is transmitted by a plurality of gears instead of the belt.

(E) In the rotary encoder 22R illustrated in FIG. 2A, the rotary plate 221 is coaxial with the PC drum 22. In addition, the rotary plate 221 of the rotary encoder 22R may be coaxial with the shaft 20S of the PC motor 20A. When the transmission mechanism includes two or more belts and three or more pulleys, the rotary plate 221 of the rotary encoder 22R may be coaxial with any of the pulleys. When the transmission mechanism includes a plurality of gears, the rotary plate 221 of the rotary encoder 22R may be coaxial with any of the gears. In this case, the rotation angle of the PC drum 22 may be converted from the product of the angle indicating the interval between the slits SLT and the count value, depending on the rotation ratio between the pulley or the gear coaxial with the rotary plate 221 and the PC drum 22.

(F) Since the rotary encoder 22R is an increment type, the detecting unit 201 detects the number of output pulses as a relative rotation angle of the PC drum 22. In this case, the control unit 202 estimates the braking distance of the PC drum 22 from the number of output pulses after the motor stop time t3. In addition, the detecting unit 201 may detect the absolute rotation angle of the PC drum 22, by utilizing an absolute type rotary encoder, or by tracking a specific mark on the surface through the image of the outer circumferential surface of the PC drum 22. In this case, the control unit 202 may estimate the braking distance of the PC drum 22 from the difference in the rotation angle of the PC drum 22 between the motor stop time t3 and the stop time.

(G) The intervals of the times T0 to T4, and t0 to t4 illustrated in the timing charts of FIGS. 5A and 6A may not exactly match the values described in the above embodiment, and may include suitable allowance (margin). Considering, for example, the detection error of the rotation angle of the PC drum 22, the time necessary for stabilizing the rotation of the PC drum 22, or the time necessary for each bias to reach the target value, this margin may be set so as not to impair the effect of preventing adhesion of carrier to the uncharged start end NTL. Specifically, for example, the delay time Δt from the default value t3 of the motor stop time is set to be longer than the time required for the developing bias illustrated in FIG. 6A to return from the developing value −VDV to the ground voltage 0 V.

(H) In the falling sequence, strictly as illustrated in FIG. 6A, the charging bias is delayed by the time Δtc from the charging end time t1 to return to the ground voltage 0 V. With this delay, the charge amount of the uncharged start end NTL strictly decreases gradually from the boundary between the charging termination LSP toward the inside. Therefore, depending on the speed at which the developing bias returns from the value −VDV at the time of development to the ground voltage 0 V after the development end time t2, in the vicinity of the boundary between the charging termination LSP and the uncharged start end NTL, a portion kept at a lower potential than the facing portion is generated, while facing the developing roller 262. In this case, since the start end of the range in which the fogging toner FTN adheres is displaced from the boundary toward the uncharged start end NTL by the width of this portion, a peeling discharge SPD is not generated between the boundary and the start end after the displacement of the range. In accordance with this, when delaying the motor stop time from the default value t3 in the falling sequence, the control unit 202 may temporarily turn off the eraser 28 at the original motor stop time t3, and may turn on the eraser 28 again after the time corresponding to the amount of displacement of the start end of the range in which the fogging toner FTN adheres. As a result, it is possible to suppress the power consumption of the eraser 28 to the minimum necessary.

(I) In FIG. 6A, the driving unit 20D naturally stops the PC drum 22, by stopping the supply of the drive voltage to the PC motor 20A at the motor stop time t3. In addition, the driving unit 20D may also control the deceleration of the PC drum 22, by positively applying braking to the PC drum 22, such as gradually reducing the drive voltage to the PC motor 20A from the motor stop time t3.

(J) The measuring unit 64 may measure a physical amount indicating the environmental conditions of the photoreceptor, such as a temperature in addition to the humidity, and the control unit 202 may evaluate the probability of occurrence of the peeling discharge SPD with the measured values. Further, when the probability of occurrence of the peeling discharge SPD is not negligible regardless of the environmental humidity of the photoreceptor, the control unit 202 may skip step S202 illustrated in FIG. 8. In this case, the measuring unit 64 may be omitted.

(K) As illustrated in FIG. 6B, when the stop position φ of the charging termination LSP exceeds the nip φ=θ2 between the PC drum 22 and the developing roller 262, the braking distance φ2 of the PC drum 22 is longer than the rotation angle from the reference position φ=0° to the nip φ=θ2. This means a drop in the pressure exerted on the PC drum 22 by the cleaning blade 27. If the pressure drop is excessive, there is a high risk of insufficiency of the cleaning effect of the blade 27. Therefore, when the stop position φ of the charging termination LSP exceeds the nip φ=θ2 between the PC drum 22 and the developing roller 262, the control unit 202 may cause the operation unit 50 to display a message, a symbol or an image warning that there is a risk of deterioration of the quality of the toner image, on the display of the operation panel 51.

Figure 10:
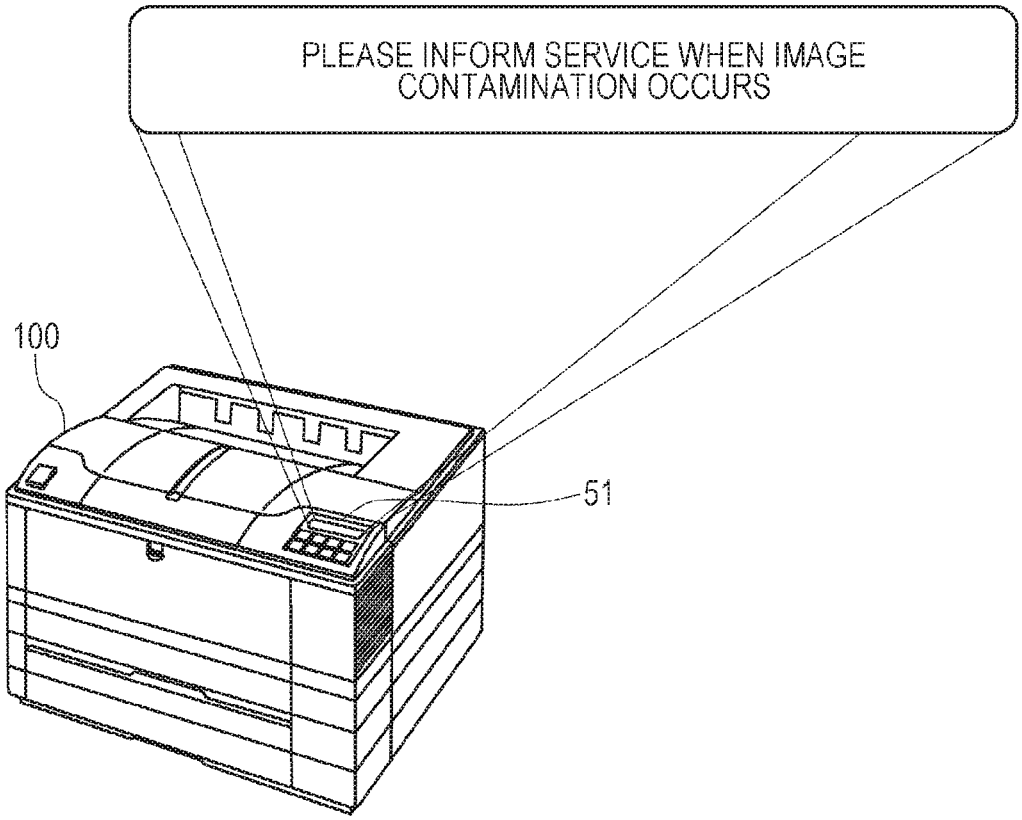
FIG. 10 is a perspective view illustrating a display on an operation panel when the stop position of the charging termination illustrated in FIG. 4F exceeds a nip between the photoreceptor drum and a developing roller.

FIG. 10 is a perspective view illustrating this display. Referring to FIG. 10, the operation unit 50 displays a message "Please inform the service when image contamination occurs" as the above-mentioned warning, on the display of the operation panel 51. Thus, it is possible to prompt the user to determine whether or not the quality of the toner image actually deteriorates beyond the allowable range.

The present invention relates to an electrophotographic image forming apparatus, and as described above, estimates a stop position thereof from a rotation angle of a PC drum in a falling sequence, and adjusts the parameters necessary for a next rising/falling sequence depending on the position. Thus, the present invention is obviously industrially applicable.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An electrophotographic image forming apparatus which sequentially performs charging, exposure, development, transfer and cleaning a surface of a photoreceptor during rotation, the apparatus comprising:

a cleaning blade configured to scrape off toner from the surface of the photoreceptor;

a detector configured to detect a rotation angle of the photoreceptor; and a control unit configured to control each of a start process and an end process of rotation of the photoreceptor and configured to control charging, development, and transfer on the each surface of the photoreceptor, wherein, in the end process, the control unit estimates, from the rotation angle of the photoconductor, a position of a portion of the surface of the photoreceptor at which a charged state caused by a peeling discharge when the cleaning blade scrapes off the toner remains even after the stop of the photoreceptor, where the rotation angle is the angle that the photoconductor rotates from the time of start of deceleration of the photoreceptor to the time of stop of the photoreceptor, and the control unit adjusts parameters necessary for the next start process or end process depending on the position.

2. The electrophotographic image farming apparatus according to claim 1, further comprising:

a driving motor configured to rotate the photoreceptor;

a charging unit configured to charge a charged portion of the surface of the photoreceptor;

an exposure unit configured to irradiate the charged portion of the surface of the photoreceptor with light to form an electrostatic latent image;

a developing unit configured to develop the electrostatic latent image as a toner image with a two-component developer;

a transfer unit configured to transfer the toner image from the photoreceptor to a sheet; and a discharging unit configured to remove electric charge from the surface of the photoreceptor after the toner image is transferred.

3. The electrophotographic image forming apparatus according to claim 2, wherein the parameters necessary for the start process comprise startup timing of each of the driving unit, the charging unit, the developing unit, the transfer unit and the discharging unit, and the parameters necessary for the end process comprise a stop timing of the each of the driving unit, the charging unit, the developing unit, the transfer unit and the discharging unit.

4. The electrophotographic image forming apparatus according to claim 2, wherein the control unit first stops the charging unit in the end process with a first surface portion of the photoreceptor facing the charging unit at a time the charging unit is stopped, the control unit stops the developing unit at a time point when the first surface portion of the photoreceptor is assumed to face the developing unit, and the control unit stops the discharging unit and the driving unit at a time point when the first surface portion of the photoreceptor is assumed to face the discharging unit, and the control unit estimates a stop position of the photoreceptor at the charging termination from a rotation angle from the time of stop of the driving unit to the time of stop of the photoreceptor, and the control unit estimates the position of the portion of the surface of the photoreceptor at which the charged state caused by the peeling discharge remains from the stop position.

5. The electrophotographic image forming apparatus according to claim 4, wherein when the stop position of the charging termination is between a position facing the charging unit and a position facing the developing unit, the control unit sets the startup timing of the developing unit earlier than the startup timing of the charging unit, among the parameters necessary for the next start process, and sets a bias voltage value immediately after the startup of the developing unit to be closer to a ground voltage than a value at the time of development.

6. The electrophotographic image forming apparatus according to claim 5, wherein the control unit sets the startup timing of the developing unit earlier than the startup timing of the charging unit, at least by a time necessary for the driving unit to cause the rotational speed of the photoreceptor to reach a target value.

7. The electrophotographic image forming apparatus according to claim 4, wherein, when the stop position of the charging termination is between a position facing the developing unit and a position facing the discharging unit, the control unit delays the stop timing of the discharging unit and the driving unit, among the parameters necessary for the next end process.

8. The electrophotographic image forming apparatus according to claim 7, wherein the control unit delays the stop timing of the discharging unit and the driving unit, at least by a time necessary for the bias voltage value of the developing unit to return from the value at the time of development to the ground voltage.

9. The electrophotographic image forming apparatus according to claim 4, further comprising:

a display unit configured to display characters, figures, or images, wherein, when the stop position of the charging termination is between a position facing the developing unit and a position facing the discharging unit, the control unit displays a message, a symbol or an image warning that there is a risk of deterioration of the quality of the toner image, on the display unit.

10. The electrophotographic image forming apparatus according to claim 4, further comprising:

a measuring unit configured to measure environmental conditions of the photoreceptor, wherein the control unit determines whether a probability of occurrence of the peeling discharge exceeds an allowable upper limit from the environmental conditions measured by the measuring unit, and when exceeding the allowable upper limit, the control unit estimates the position of the portion of the surface of the photoreceptor at which the charged state caused by the peeling discharge remains.

* * * * *